US011096445B2

(12) United States Patent
Walker et al.

(10) Patent No.: US 11,096,445 B2
(45) **Date of Patent: *Aug. 24, 2021**

(54) FOOTWEAR INCLUDING AN INCLINE ADJUSTER

(71) Applicant: NIKE, Inc., Beaverton, OR (US)

(72) Inventors: Steven H. Walker, Camas, WA (US); Chin-yuan Cheng, Kirkland, WA (US)

(73) Assignee: NIKE, Inc., Beaverton, OR (US)

( * ) Notice: Subject to any disclaimer, the term of this patent is extended or adjusted under 35 U.S.C. 154(b) by 86 days.

This patent is subject to a terminal disclaimer.

(21) Appl. No.: 15/785,601

(22) Filed: Oct. 17, 2017

(65) Prior Publication Data

US 2018/0035752 A1 Feb. 8, 2018

Related U.S. Application Data

(63) Continuation of application No. 14/725,218, filed on May 29, 2015, now Pat. No. 9,820,531.

(51) Int. Cl.
*A43B 13/18* (2006.01)
*A43B 3/24* (2006.01)
(Continued)

(52) U.S. Cl.
CPC ..... *A43B 13/143* (2013.01); *A43B 3/0005* (2013.01); *A43B 3/246* (2013.01);
(Continued)

(58) Field of Classification Search
CPC ..... A43B 7/38; A43B 7/1425; A43B 7/1435; A43B 5/06; A43B 13/143; A43B 13/189;
(Continued)

(56) References Cited

U.S. PATENT DOCUMENTS 4,183,156 A * 1/1980 Rudy ..... A43B 17/035 36/29
4,219,945 A * 9/1980 Rudy ..... A43B 13/203 36/29

(Continued)

FOREIGN PATENT DOCUMENTS

CN 1372441 A 10/2002
CN 2930369 Y 8/2007

(Continued)

OTHER PUBLICATIONS

Nov. 6, 2018—(WO) ISR & WO—App. No. PCT/US18/048719.

(Continued)

*Primary Examiner* — Heather Mangine
(74) *Attorney, Agent, or Firm* — Banner & Witcoff, Ltd.

(57) ABSTRACT

A sole structure may include chambers and a transfer channel containing an electrorheological fluid. Electrodes may be positioned to create, in response to a voltage across the electrodes, an electrical field in at least a portion of the electrorheological fluid in the transfer channel. The sole structure may further include a controller including a processor and memory. At least one of the processor and memory may store instructions executable by the processor to perform operations that include maintaining the voltage across the electrodes at one or more flow-inhibiting levels at which flow of the electrorheological fluid the through the transfer channel is blocked, and that further include maintaining the voltage across the electrodes at one or more flow-enabling levels permitting flow of the electrorheological fluid through the transfer channel.

19 Claims, 15 Drawing Sheets

(51) Int. Cl.

| | |
|---|---|
| ***A43B 5/06*** | (2006.01) |
| ***A43B 13/14*** | (2006.01) |
| ***A43B 3/00*** | (2006.01) |
| ***A43B 7/24*** | (2006.01) |
| ***A43B 7/14*** | (2006.01) |

(52) U.S. Cl.
CPC ..... *A43B 5/06* (2013.01); *A43B 7/1425* (2013.01); *A43B 7/24* (2013.01); *A43B 13/189* (2013.01)

(58) Field of Classification Search
CPC ..... A43B 3/0005; A43B 3/0015; A43B 3/246; A43B 13/20; A43B 7/24
USPC ..... 36/150, 153, 129, 142, 143, 144, 25 R
See application file for complete search history.

(56) References Cited

U.S. PATENT DOCUMENTS 4,471,538 A * 9/1984 Pomeranz ..... A43B 13/189 188/322.5
4,651,443 A 3/1987 Eckstrom
4,898,084 A * 2/1990 Oppermann ..... G01D 5/24 73/115.01
4,999,931 A * 3/1991 Vermeulen ..... A43B 13/185 36/153
5,222,312 A 6/1993 Doyle
5,335,382 A * 8/1994 Huang ..... A43B 13/203 297/199
5,343,639 A * 9/1994 Kilgore ..... A43B 13/183 36/27
5,493,792 A * 2/1996 Bates ..... A43B 13/189 36/153
5,686,167 A * 11/1997 Rudy ..... A43B 13/189 36/29
5,771,606 A 6/1998 Litchfield et al.
5,794,366 A * 8/1998 Chien ..... F21S 8/035 40/540
5,813,142 A * 9/1998 Demon ..... A43B 3/0005 36/28
5,896,682 A * 4/1999 Lin ..... A43B 13/189 36/29
5,979,086 A * 11/1999 Vindriis ..... A43B 7/1415 36/153
6,058,341 A * 5/2000 Myers ..... B60N 2/002 701/45
6,059,062 A * 5/2000 Staelin ..... A63C 17/12 180/181
6,138,382 A * 10/2000 Schoesler ..... A43B 7/147 36/153
6,349,487 B1 * 2/2002 Hice ..... A43B 13/143 36/140
6,378,558 B1 * 4/2002 Pohl ..... F16F 9/34 137/807
6,433,465 B1 * 8/2002 McKnight ..... A43B 3/0005 310/319
6,519,873 B1 2/2003 Buttigieg
6,740,125 B2 * 5/2004 Mosler ..... A61F 2/64 188/267.1
6,751,891 B2 * 6/2004 Lombardino ..... A43B 13/182 36/142
6,812,624 B1 11/2004 Pei et al.
6,845,573 B2 * 1/2005 Litchfield ..... A43B 13/203 36/141
6,971,193 B1 * 12/2005 Potter ..... A43B 13/203 36/141
7,007,412 B2 3/2006 Munster
7,200,956 B1 * 4/2007 Kotha ..... A43B 1/0054 36/1
7,204,041 B1 * 4/2007 Bailey, Sr. ..... A43B 3/0005 36/1
7,219,449 B1 * 5/2007 Hoffberg ..... A43B 1/0054 36/29
7,254,908 B2 8/2007 Ungari
7,409,779 B2 * 8/2008 Dojan ..... A43B 7/144 36/29
7,484,318 B2 * 2/2009 Finkelstein ..... A43B 13/187 36/153
7,950,169 B2 * 5/2011 Holt ..... A43B 13/20 36/153
8,234,800 B2 * 8/2012 Buder ..... A43B 3/0005 36/143
8,302,327 B2 * 11/2012 Battlogg ..... F16K 31/082 137/807
8,324,800 B2 12/2012 Royster, Jr. et al.
8,973,613 B2 * 3/2015 Murphy ..... F15B 21/065 137/827
9,107,475 B2 8/2015 Ellis
9,271,538 B2 * 3/2016 Ellis ..... A43B 7/1425
9,820,531 B2 * 11/2017 Walker ..... A43B 13/143
9,885,083 B2 * 2/2018 Conradson ..... G01N 33/543
2002/0133237 A1 * 9/2002 Christesen ..... A61F 2/66 623/24
2003/0056401 A1 * 3/2003 Kwon ..... A43B 5/001 36/127
2003/0101620 A1 * 6/2003 Reed ..... A43B 7/1425 36/30 A
2003/0120353 A1 * 6/2003 Christensen ..... A43B 3/0005 623/26
2003/0154628 A1 * 8/2003 Gyr ..... A43B 13/141 36/25 R
2003/0212352 A1 * 11/2003 Kahn ..... A61H 1/008 601/98
2004/0002665 A1 * 1/2004 Parihar ..... A43B 3/0005 600/587
2004/0040183 A1 * 3/2004 Kerrigan ..... A43B 3/0063 36/144
2004/0154190 A1 * 8/2004 Munster ..... A43B 1/0054 36/28
2004/0177531 A1 * 9/2004 DiBenedetto ..... A43B 1/0054 36/132
2004/0211085 A1 * 10/2004 Passke ..... A43B 13/189 36/3 B
2005/0172515 A1 * 8/2005 Ungari ..... A43B 1/0054 36/88
2005/0183292 A1 * 8/2005 DiBenedetto ..... A43B 1/0009 36/132
2005/0268487 A1 12/2005 Ellis
2006/0143645 A1 * 6/2006 Vock ..... A43B 3/00 725/9
2006/0241783 A1 * 10/2006 Christensen ..... A43B 3/0005 623/56
2006/0248749 A1 * 11/2006 Ellis ..... A43B 3/0005 36/28
2006/0248750 A1 * 11/2006 Rosenberg ..... A43B 1/0054 36/29
2006/0262120 A1 * 11/2006 Rosenberg ..... G06F 3/011 345/473
2007/0000154 A1 * 1/2007 DiBenedetto ..... A43B 1/0036 36/132
2007/0006489 A1 * 1/2007 Case, Jr. ..... A43B 3/0005 36/132
2008/0016719 A1 * 1/2008 Aveni ..... A43B 3/0042 36/28
2008/0245985 A1 10/2008 Heim et al.
2008/0315872 A1 * 12/2008 Kwun ..... G01N 27/82 324/262
2009/0200501 A1 8/2009 Heim et al.
2009/0235557 A1 * 9/2009 Christensen ..... A43B 3/24 36/29
2009/0248760 A1 10/2009 Tone et al.
2009/0282704 A1 * 11/2009 Park ..... A43B 7/1425 36/3 B
2010/0211355 A1 * 8/2010 Horst ..... A61B 5/1038 702/173
2010/0251565 A1 * 10/2010 Litchfield ..... A43B 13/12 36/28
2010/0251574 A1 10/2010 Battlogg et al.
2011/0107622 A1 5/2011 Schwirian

(56) References Cited

U.S. PATENT DOCUMENTS

| | | | | |
|---|---|---|---|---|
| 2012/0233878 | A1* | 9/2012 | Hazenberg | A43B 13/20 36/29 |
| 2012/0273053 | A1 | 11/2012 | Murphy et al. | |
| 2012/0291564 | A1* | 11/2012 | Amos | G01C 22/006 73/862.045 |
| 2012/0324763 | A1 | 12/2012 | Ellis, III | |
| 2013/0016364 | A1 | 1/2013 | Tanaka | |
| 2013/0019694 | A1* | 1/2013 | Molyneux | A43B 3/0005 73/862.381 |
| 2013/0033042 | A1* | 2/2013 | Fortier | A43B 3/0015 290/54 |
| 2013/0160329 | A1* | 6/2013 | Peyton | A43B 5/06 36/105 |
| 2013/0185003 | A1 | 7/2013 | Carbeck et al. | |
| 2013/0213147 | A1* | 8/2013 | Rice | G01L 1/20 73/862.046 |
| 2013/0278436 | A1 | 10/2013 | Ellis | |
| 2013/0291407 | A1* | 11/2013 | Adair | A43B 5/00 36/126 |
| 2013/0333625 | A1* | 12/2013 | Baxter | A01K 1/0114 119/166 |
| 2014/0033572 | A1* | 2/2014 | Steier | A43B 3/0005 36/103 |
| 2014/0053427 | A1* | 2/2014 | Patton | A43B 13/189 36/29 |
| 2014/0059781 | A1* | 3/2014 | Lafleche | A47C 27/083 5/713 |
| 2014/0068973 | A1* | 3/2014 | Krupenkin | A43B 3/0015 36/136 |
| 2014/0250726 | A1* | 9/2014 | Meschter | A43B 13/189 36/102 |
| 2014/0277632 | A1* | 9/2014 | Walker | G01L 1/2206 700/91 |
| 2015/0157091 | A1 | 6/2015 | Hsu | |
| 2015/0177081 | A1* | 6/2015 | Steier | G01L 1/205 600/592 |
| 2015/0297437 | A1* | 10/2015 | Neuenhahn | A61B 5/4848 601/148 |
| 2016/0044993 | A1 | 2/2016 | Meschter et al. | |
| 2016/0235160 | A1 | 8/2016 | Lam et al. | |
| 2016/0345663 | A1 | 12/2016 | Walker et al. | |
| 2016/0345669 | A1 | 12/2016 | Grand et al. | |
| 2016/0345670 | A1 | 12/2016 | Orand | |
| 2016/0367192 | A1* | 12/2016 | Iyengar | A61B 5/6807 |
| 2017/0106940 | A1 | 4/2017 | Paick | |
| 2017/0348181 | A1 | 12/2017 | Perriard et al. | |
| 2018/0132566 | A1 | 5/2018 | Rosenblatt et al. | |
| 2019/0059511 | A1 | 2/2019 | Walker et al. | |
| 2019/0059514 | A1 | 2/2019 | Walker et al. | |
| 2019/0110551 | A1 | 4/2019 | Walker | |

FOREIGN PATENT DOCUMENTS

| | | | |
|---|---|---|---|
| CN | 101708087 | A | 5/2010 |
| CN | 101856161 | A | 10/2010 |
| CN | 102595949 | A | 7/2012 |
| CN | 103250203 | A | 8/2013 |
| CN | 103776461 | A | 5/2014 |
| CN | 104146850 | A | 11/2014 |
| CN | 204580030 | U | 8/2015 |
| CN | 105231582 | A | 1/2016 |
| CN | 105266256 | A | 1/2016 |
| CN | 105631195 | A | 6/2016 |
| CN | 105815866 | A | 8/2016 |
| CN | 205568003 | U | 9/2016 |
| CN | 106063607 | A | 11/2016 |
| CN | 106136419 | A | 11/2016 |
| CN | 206025343 | U | 3/2017 |
| CN | 106595912 | A | 4/2017 |
| CN | 106858891 | A | 6/2017 |
| CN | 107003188 | A | 8/2017 |
| EP | 1210883 | A1 | 6/2002 |
| EP | 2774502 | A1 | 9/2014 |
| JP | H11117985 | A | 4/1999 |
| JP | 2005279281 | A | 10/2005 |
| JP | 2009540237 | A | 11/2009 |
| JP | 2013215530 | A | 10/2013 |
| KR | 20130068881 | A | 6/2013 |
| KR | 20140109647 | A | 9/2014 |
| WO | 93012685 | A1 | 7/1993 |
| WO | 9835529 | A2 | 8/1998 |
| WO | 2008156860 | A1 | 12/2008 |
| WO | 2009152456 | A2 | 12/2009 |
| WO | 2012112931 | A2 | 8/2012 |
| WO | 2014138020 | A1 | 9/2014 |
| WO | 2016191204 | A1 | 12/2016 |
| WO | 2017095850 | A1 | 6/2017 |

OTHER PUBLICATIONS

Dec. 6, 2018—(WO) ISR & WO—App. No. PCT/US18/048708.
Dec. 21, 2018—(EP) Supp. ESR—App. No. 16804005.3.
Demon, Ronald, "Black History in America" Internet Archive Wayback Machine, http://www.myblackhistor.net/Ronald_Demon.htm, pp. 1-2.
Sep. 19, 2016—(WO ) ISR & WO—App. No. PCT/US16/033899.

* cited by examiner

FIG. 5C1

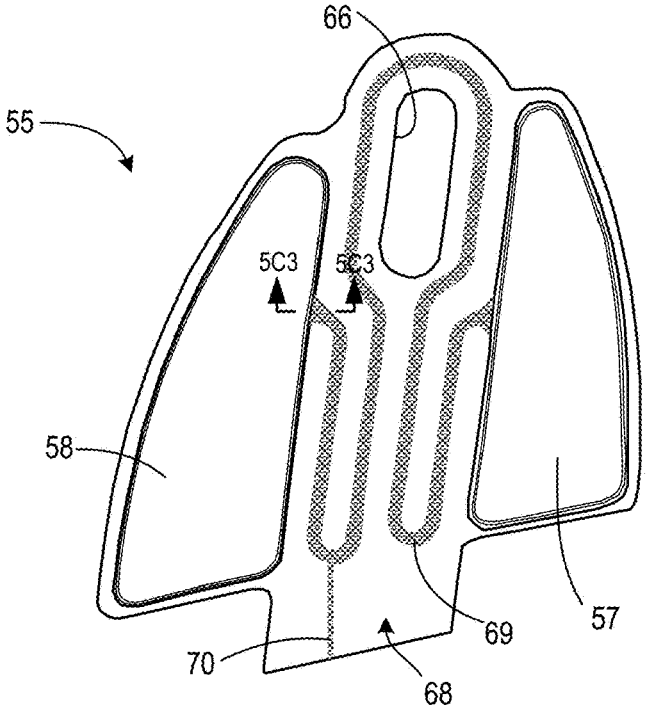
FIG. 5C2
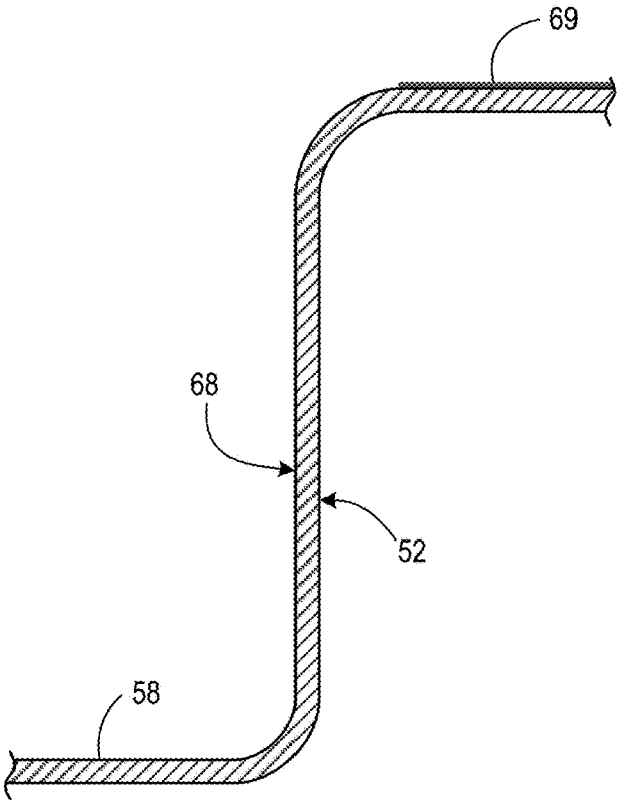
FIG. 5C3

FOOTWEAR INCLUDING AN INCLINE ADJUSTER

CROSS-REFERENCE TO RELATED APPLICATION

This application is a continuation of U.S. patent application Ser. No. 14/725,218, filed May 29, 2015. application Ser. No. 14/725,218, in its entirety, is incorporated by reference herein.

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking, or running.

Conventional footwear is often designed with the goal of optimizing a shoe for a particular condition or set of conditions. For example, sports such as tennis and basketball require substantial side-to-side movements. Shoes designed for wear while playing such sports often include substantial reinforcement and/or support in regions that experience more force during sideways movements. As another example, running shoes are often designed for forward movement by a wearer in a straight line. Difficulties can arise when a shoe must be worn during changing conditions, or during multiple different types of movements.

SUMMARY

This Summary is provided to introduce a selection of concepts in a simplified form that are further described below in the Detailed Description. This Summary is not intended to identify key features or essential features of the invention.

In at least some embodiments, a sole structure for an article of footwear may include a first chamber positioned under and supporting a first portion of a footbed. The first chamber may contain an electrorheological fluid and may have a height that varies in response to transfer of the electrorheological fluid into and out of the first chamber. The sole structure may further include a second chamber positioned under and supporting a second portion of the footbed, with the second chamber containing the electrorheological fluid and having a height that varies in response to transfer of the electrorheological fluid into and out of the second chamber. A transfer channel may be in fluid communication with interiors of the first and second chambers and may contain the electrorheological fluid. Electrodes may be positioned to create, in response to a voltage across the electrodes, an electrical field in at least a portion of the electrorheological fluid in the transfer channel. The sole structure may further include a controller including a processor and memory. At least one of the processor and memory may store instructions executable by the processor to perform operations that include maintaining the voltage across the electrodes at one or more flow-inhibiting levels at which flow of the electrorheological fluid the through the transfer channel is blocked, and that further include maintaining the voltage across the electrodes at one or more flow-enabling levels permitting flow of the electrorheological fluid through the transfer channel.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

FIG. 5C1 is a top view of a top layer of the incline adjuster of FIG. 4A.

FIG. 5C2 is a bottom view of the top layer of the incline adjuster of FIG. 4A.

FIG. 5C3 is a partial area cross-sectional view of the top layer of the incline adjuster of FIG. 4A.

DETAILED DESCRIPTION

Figure 1:
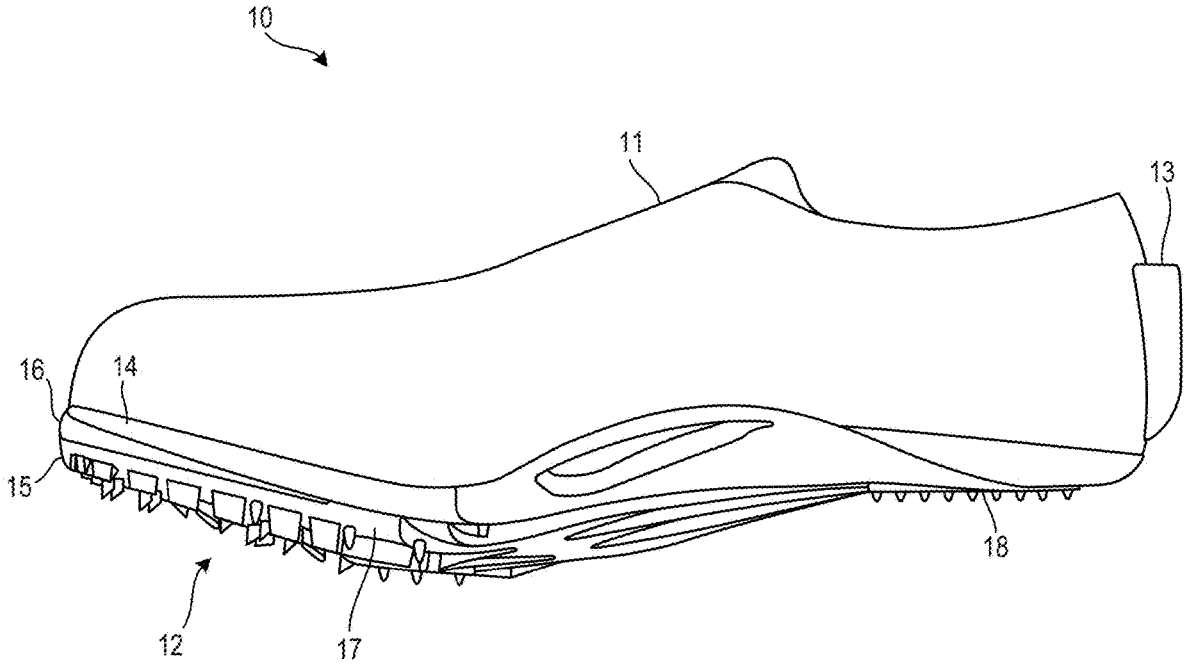
FIG. 1 is a medial side view of a shoe according to some embodiments.

In various types of activities, it may be advantageous to change the shape of a shoe or shoe portion while a wearer of that shoe is running or otherwise participating in the activity. In many running competitions, for example, athletes race around a track having curved portions, also known as "bends." In some cases, particularly shorter events such as 200 meter or 400 meter races, athletes may be running at sprint paces on a track bend. Running on a flat curve at a fast pace is biomechanically inefficient, however, and may require awkward body movements. To counteract such effects, bends of some running tracks are banked. This banking allows more efficient body movement and typically results in faster running times. Tests have shown that similar advantages can be achieved by altering the shape of a shoe. In particular, running on a flat track bend in a shoe having a footbed that is inclined relative to the ground can mimic the benefits of running on a banked bend in a shoe having a non-inclined footbed. However, an inclined footbed is a disadvantage on straight portions of a running track. Footwear that can provide an inclined footbed when running on a bend and reduce or eliminate the incline when running on a straight track section would offer a significant advantage.

In footwear according to some embodiments, electrorheological (ER) fluid is used to change the shape of one or more shoe portions. ER fluids typically comprise a non-conducting oil or other fluid in which very small particles are suspended. In some types of ER fluid, the particles may be have diameters of 5 microns or less and may be formed from polystyrene or another polymer having a dipolar molecule. When an electric field is imposed across the ER fluid, the viscosity of the fluid increases as the strength of that field increases. As described in more detail below, this effect can be used to control transfer of fluid and modify the shape of a footwear component. Although track shoe embodiments are initially described, other embodiments include footwear intended for other sports or activities.

To assist and clarify subsequent description of various embodiments, various terms are defined herein. Unless context indicates otherwise, the following definitions apply throughout this specification (including the claims). "Shoe" and "article of footwear" are used interchangeably to refer to an article intended for wear on a human foot. A shoe may or may not enclose the entire foot of a wearer. For example, a shoe could include a sandal-like upper that exposes large portions of a wearing foot. The "interior" of a shoe refers to space that is occupied by a wearer's foot when the shoe is worn. An interior side, surface, face, or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Shoe elements can be described based on regions and/or anatomical structures of a human foot wearing that shoe, and by assuming that the interior of the shoe generally conforms to and is otherwise properly sized for the wearing foot. A forefoot region of a foot includes the heads and bodies of the metatarsals, as well as the phalanges. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

Unless indicated otherwise, a longitudinal axis refers to a horizontal heel-toe axis along the center of the foot that is roughly parallel to a line along the second metatarsal and second phalanges. A transverse axis refers to a horizontal axis across the foot that is generally perpendicular to a longitudinal axis. A longitudinal direction is generally parallel to a longitudinal axis. A transverse direction is generally parallel to a transverse axis.

FIG. 1 is a medial side view of a track shoe 10 according to some embodiments. The lateral side of shoe 10 has a similar configuration and appearance, but is configured to correspond to a lateral side of a wearer foot. Shoe 10 is configured for wear on a right foot and is part of a pair that includes a shoe (not shown) that is a mirror image of shoe 10 and is configured for wear on a left foot. As explained in more detail below, however, shoe 10 and its corresponding left shoe may be configured to alter their shapes in different ways under a given set of conditions.

Shoe 10 includes an upper 11 attached to a sole structure 12. Upper 11 may be formed from any of various types or materials and have any of a variety of different constructions. In some embodiments, for example, upper 11 may be knitted as a single unit and may not include a bootie of other type of liner. In some embodiments, upper 11 may be slip lasted by stitching bottom edges of upper 11 to enclose a foot-receiving interior space. In other embodiments, upper 11 may be lasted with a strobel or in some other manner. A battery assembly 13 is located in a rear heel region of upper 11 and includes a battery that provides electrical power to a controller. The controller is not visible in in FIG. 1, but is described below in connection with other drawing figures.

Sole structure 12 includes a footbed 14, an outsole 15, and an incline adjuster 16. Incline adjuster 16 is situated between outsole 15 and footbed 14 in a forefoot region. As explained in more detail below, incline adjuster 16 includes a medial side fluid chamber that supports a medial forefoot portion of footbed 14, as well as a lateral side fluid chamber that supports a lateral forefoot portion of footbed 14. ER fluid may be transferred between those chambers through a connecting transfer channel that is in fluid communication with the interiors of both chambers. That fluid transfer may raise the height of one chamber relative to the other chamber, resulting in an incline in a portion of footbed 14 located over the chambers. When further flow of ER fluid through the channel is interrupted, the incline is maintained until ER fluid flow is allowed to resume.

Figure 2A:
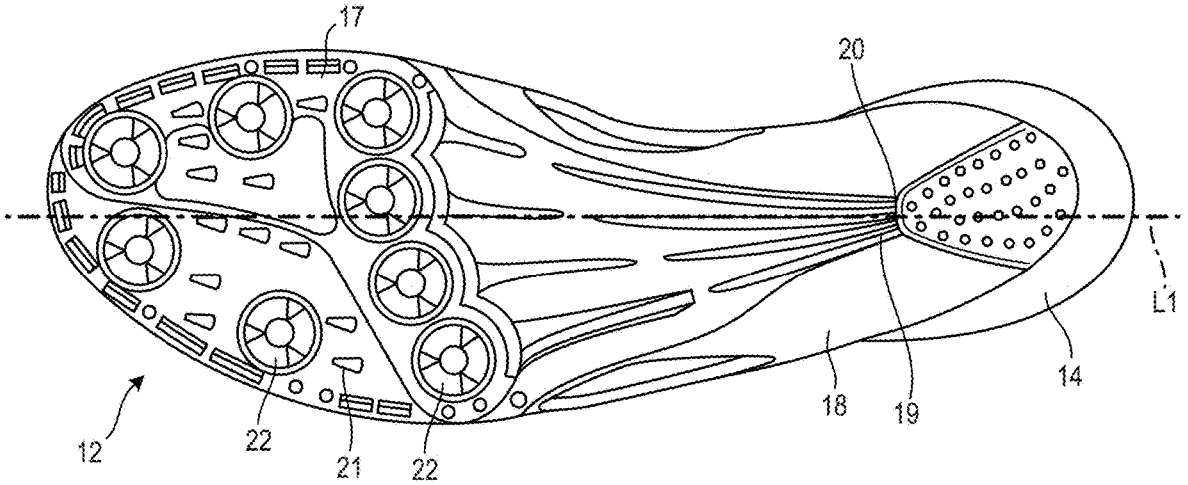
FIG. 2A is a bottom view of the sole structure of the shoe of FIG. 1.
Figure 2B:
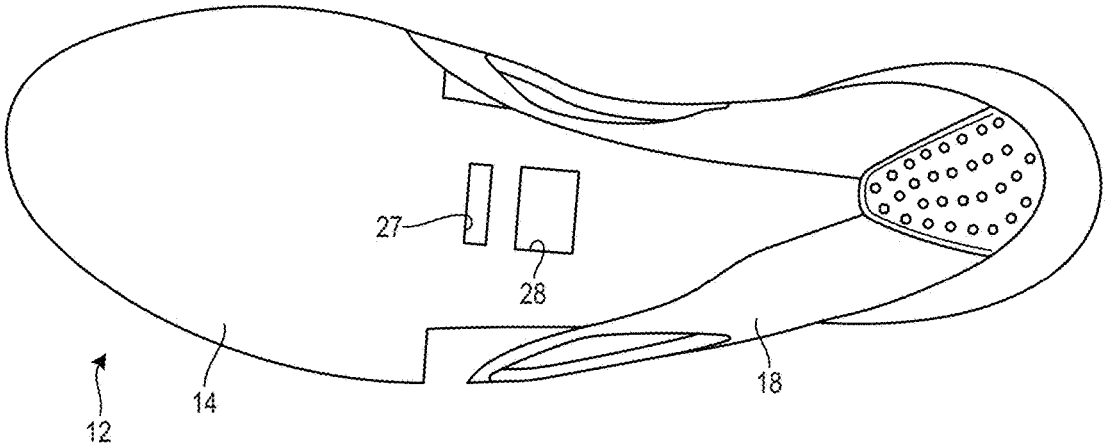
FIG. 2B is a bottom view of the sole structure of the shoe of FIG. 1, but with a forefoot outsole element and an incline adjuster removed.
Figure 2C:
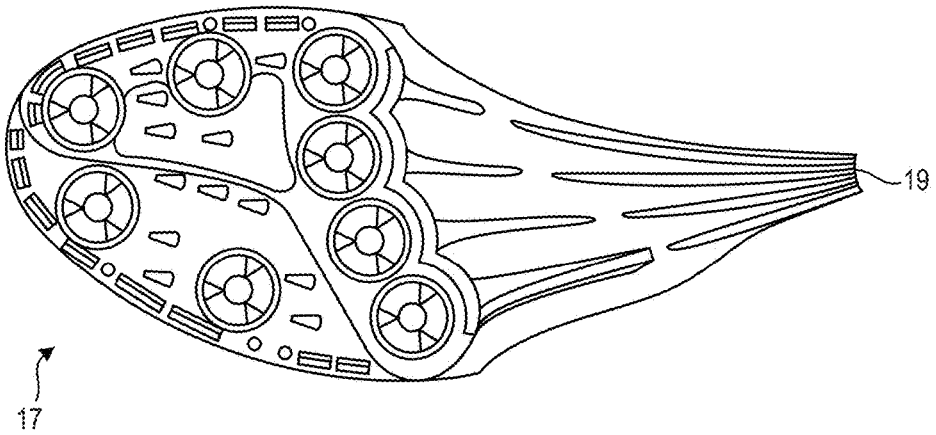
FIG. 2C is a bottom view of the forefoot outsole element of the sole structure of the shoe of FIG. 1.

Outsole 15 forms the ground-contacting portion of sole structure 12. In the embodiment of shoe 10, outsole 15 includes a forward outsole section 17 and a rear outsole section 18. The relationship of forward outsole section 17 and rear outsole section 18 can be seen by comparing FIG. 2A, a bottom view of sole structure 12, and FIG. 2B, a bottom view of sole structure 12 with forefoot outsole section 17 and incline adjuster 16 removed. FIG. 2C is a bottom view of forefoot outsole section 17 removed from sole structure 12. As seen in FIG. 2A, forward outsole section 17 extends through forefoot and central midfoot regions of sole structure 12 and tapers to a narrowed end 19. End 19 is attached to rear outsole section 18 at a joint 20 located in the heel region. Rear outsole section 18 extends over side midfoot regions and over the heel region and is attached to footbed 14. Forward outsole section 17 is also coupled to footbed 14 by a fulcrum element and by the above-mentioned fluid chambers of incline adjuster 16. Forefoot outsole section 17 pivots about a longitudinal axis L1 passing through joint 20 and through the forefoot fulcrum element. In particular, and as explained below, forefoot outsole section 17 rotates about axis L1 as a forefoot portion of footbed 14 inclines relative to forefoot outsole section 17.

Outsole 15 may be formed of a polymer or polymer composite and may include rubber and/or other abrasion-resistant material on ground-contacting surfaces. Traction elements 21 may be molded into or otherwise formed in the bottom of outsole 15. Forefoot outsole section 17 may also include receptacles to hold one or more removable spike elements 22. In other embodiments, outsole 15 may have a different configuration.

Footbed 14 includes a midsole 25. In the embodiment of shoe 10, midsole 25 has a size and a shape approximately corresponding to a human foot outline, is a single piece that extends the full length and width of footbed 14, and includes a contoured top surface 26 (shown in FIG. 3). The contour of top surface 26 is configured to generally correspond to the shape of the plantar region of a human foot and to provide arch support. Midsole 25 may be formed from ethylene vinyl acetate (EVA) and/or one or more other closed cell polymer foam materials. Midsole 25 may also have pockets 27 and 28 formed therein to house a controller and other electronic components, as described below. Upwardly extending medial and lateral sides of rear outsole section 18 may also provide additional medial and lateral side support to a wearer foot. In other embodiments, a footbed may have a different configuration, e.g., a midsole may cover less than all of a footbed or may be entirely absent, and/or a footbed may include other components.

Figure 3:
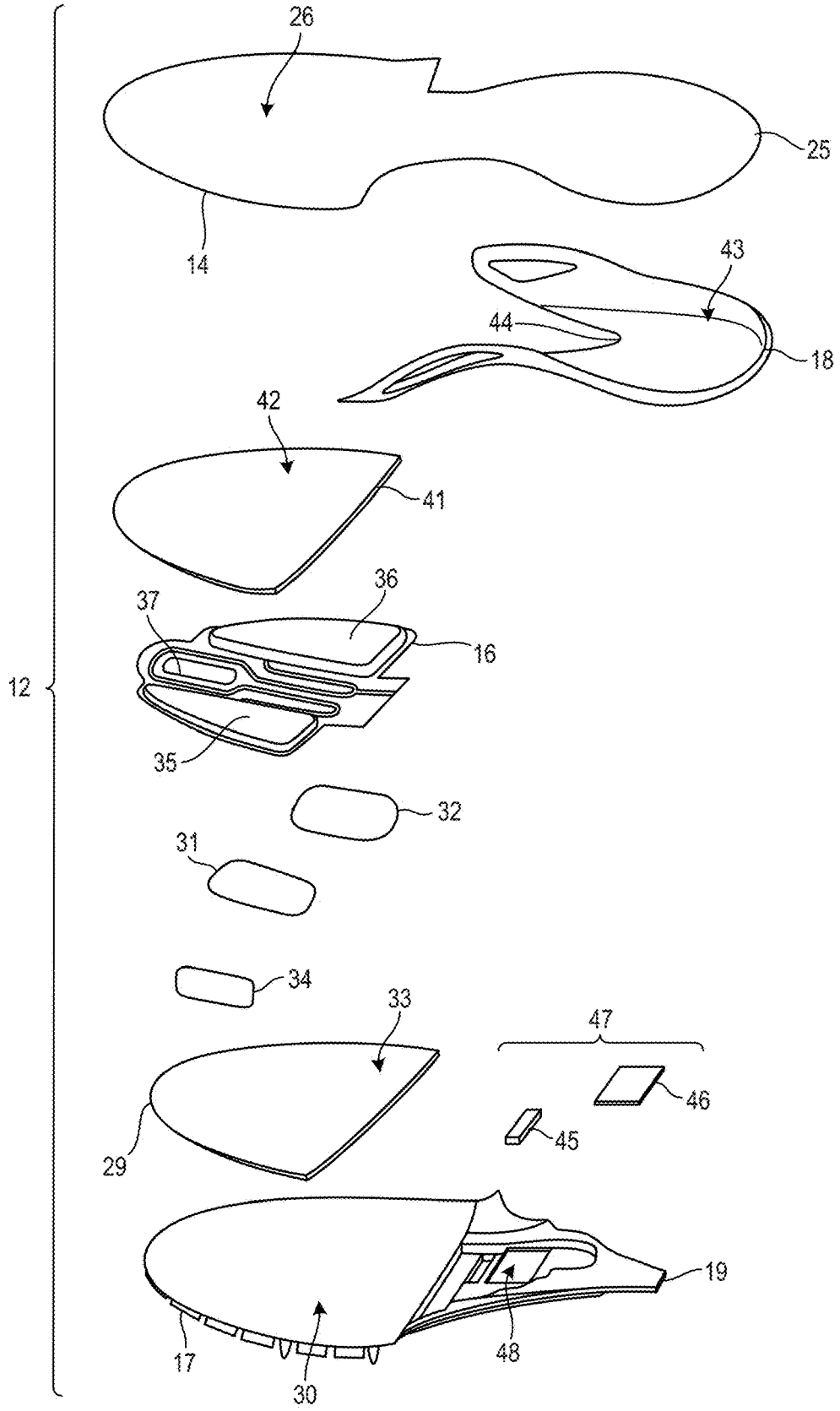
FIG. 3 is a partially exploded medial perspective view of the sole structure of the shoe of FIG. 1.

FIG. 3 is a partially exploded medial perspective view of sole structure 12. Bottom support plate 29 is located in a plantar region of shoe 10. In the embodiment of shoe 10, bottom support plate 29 is attached to a top surface 30 of forward outsole section 17. Bottom support plate 29, which may be formed from a relatively stiff polymer or polymer composite, helps to stiffen the forefoot region of forward outsole section 17 and provide a stable base for incline adjuster 16. A medial force-sensing resistor (FSR) 31 and a lateral FSR 32 are attached to a top surface 33 of bottom support plate 29. As explained below, FSRs 31 and 32 provide outputs that help determine pressures within chambers of incline adjuster 16.

Fulcrum element 34 is attached to top surface 33 of lower support plate 29 and extends to the bottom surface of the top support plate 41. Fulcrum element 34 is positioned between FSRs 31 and 32 in a front portion of bottom support plate 29. Fulcrum element 34 may be formed from hard rubber or from one or more other materials that is generally incompressible under loads that result when a wearer of shoe 10 runs.

Incline adjuster 16 is attached to top surface 33 of lower support plate 29. A medial fluid chamber 35 of incline adjuster 16 is positioned over medial FSR 31. A lateral fluid chamber 36 of incline adjuster 16 is positioned over lateral FSR 32. Incline adjuster 16 includes an aperture 37 through which fulcrum element 34 extends. At least a portion of fulcrum element 34 is positioned between chambers 35 and 36. Additional details of incline adjuster 16 are discussed in connection with FIGS. 4A-5C3. A top support plate 41 is also located in a plantar region of shoe 10 and is positioned over incline adjuster 16. In the embodiment of shoe 10, top support plate 41 is generally aligned with bottom support plate 29. Top support plate 41, which may also be formed from a relatively stiff polymer or polymer composite, provides a stable and relatively non-deformable region against which incline adjuster 16 may push, and which supports the forefoot region of footbed 14.

A forefoot region portion of the midsole 25 underside is attached to the top surface 42 of top support plate 41. Portions of the midsole 25 underside in the heel and side midfoot regions are attached to a top surface 43 of rear outsole section 18. End 19 of forward outsole section 17 is attached to rear outsole section 18 behind the rear-most location 44 of the front edge of section 18 so as to form joint 20. In some embodiments, end 19 may be a tab that slides into a slot formed in section 18 at or near location 14, and/or may be wedged between top surface 43 and the underside of midsole 25. As seen in FIG. 3, the chambers, transfer channel, and ER fluid are absent in the heel region.

Also shown in FIG. 3 are a DC-to-high-voltage-DC converter 45 and a printed circuit board (PCB) 46 of a controller 47. Converter 45 converts a low voltage DC electrical signal into a high voltage (e.g., 5000V) DC signal that is applied to electrodes within incline adjuster 16. PCB 46 includes one or more processors, memory and other components and is configured to control incline adjuster 16 through converter 45. PCB 46 also receives inputs from FSRs 31 and 32 and receives electrical power from battery unit 13. PCB 46 and converter 45 may be attached to the top surface of forward outsole section 17 in a midfoot region 48, and may also rest within pockets 28 and 27, respectively, in the underside midsole 25.

Figure 4A:
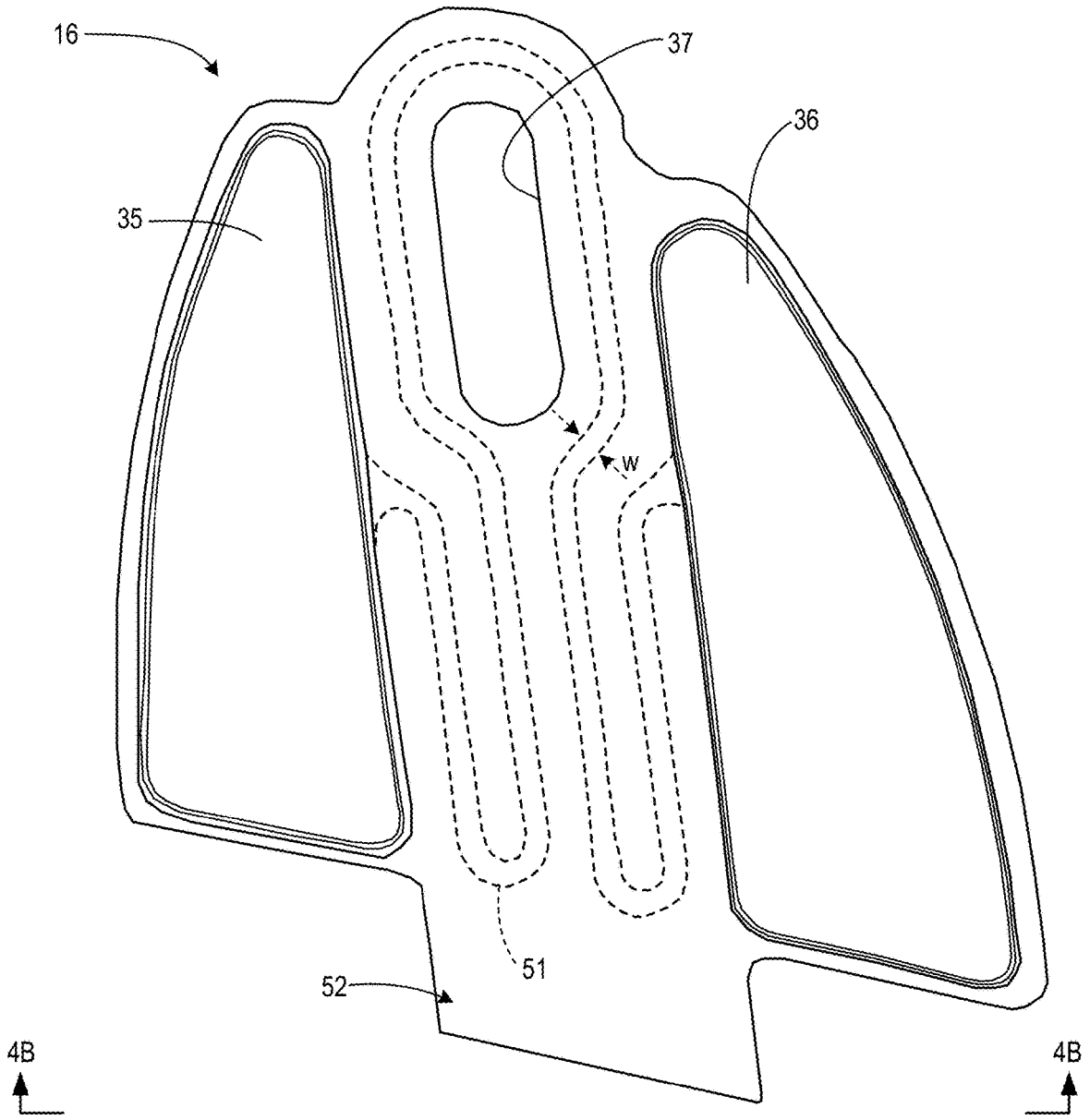
FIG. 4A is an enlarged top view of an incline adjuster of the shoe of FIG. 1.
Figure 4B:
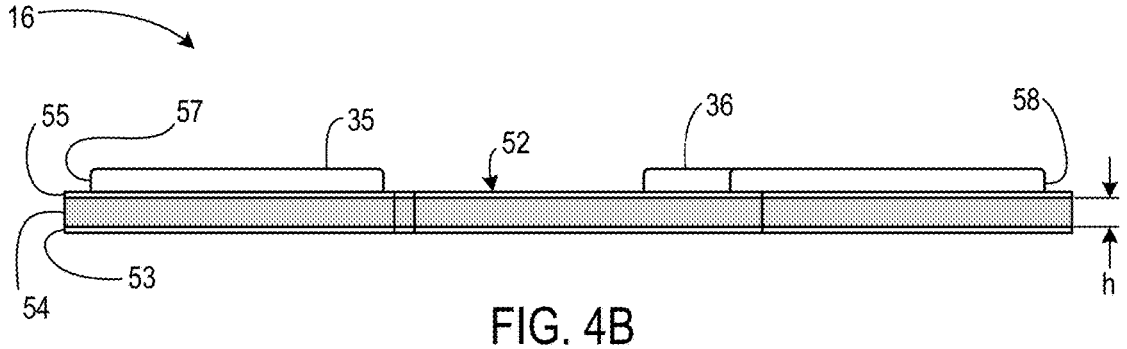
FIG. 4B is a rear edge view of the incline adjuster of FIG. 4A.

FIG. 4A is an enlarged top view of incline adjuster 16. FIG. 4B is a rear edge view of incline adjuster 16 from the location indicated in FIG. 4A. Medial fluid chamber 35 is in fluid communication with lateral fluid chamber 36 through a fluid transfer channel 51. An ER fluid fills chambers 35 and 36 and transfer channel 51. One example of an ER fluid that may be used in some embodiments is sold under the name "RheOil 4.0" by ERF Produktion Würzberg GmbH. In the present example, it is assumed that the top of incline adjuster 16 is formed by an opaque layer, and thus transfer channel 51 is indicated in FIG. 4A with broken lines.

Transfer channel 51 has a serpentine shape so as to provide increased surface area for electrodes within channel 51 to create an electrical field in fluid within channel 51. For example, and as seen in FIG. 4A, channel 51 includes three 180° curved sections joining other sections of channel 51 that cover the space between chambers 35 and 36. In some embodiments, transfer channel 51 may have a maximum height h (FIG. 4B) of 1 millimeter (mm), an average width (w) of 2 mm, and a minimum length along the flow direction of at least 257 mm.

In some embodiments, height of the transfer channel may practically be limited to a range of at least 0.250 mm to not more than 3.3 mm. An incline adjuster constructed of pliable material may be able to bend with the shoe during use. Bending across the transfer channel locally decreases the height at the point of bending. If sufficient allowance is not made, the corresponding increase in electric field strength may exceed the maximum dielectric strength of the ER fluid, causing the electric field to collapse. In the extreme, electrodes could become so close so as to actually touch, with the same resultant electric field collapse.

The viscosity of ER fluid increases with the applied electric field strength. The effect is non-linear and the optimum field strength is in the range of 3 to 6 kilovolts per millimeter (kV/mm). The high-voltage dc-dc converter used to boost the 3 to 5 V of the battery may be limited by physical size and safety considerations to less than 2 W or a maximum output voltage of less than or equal to 10 kV. To keep the electric field strength within the desired range, the height of the transfer channel may therefore be limited in some embodiments to a maximum of about 3.3 mm (10 kV/3 kV/mm).

The width of the transfer channel may be practically limited to a range of at least 0.5 mm to not more than 4 mm. As explained below, an incline adjuster may be constructed of 3 or more layers of thermal plastic urethane film. The layers of film may be bonded together with heat and pressure. During this lamination process, temperatures in portions of the materials may exceed the glass transition temperature when melting so as to bond melted materials of adjoining layers. The pressure during bonding inter-mixes the melted material, but may also extrude a portion of the melted material into the transfer channel preformed within the middle spacer layer of the incline adjuster. The channel may thus be partially filled by this material. At channel widths less than 0.5 mm, the proportion of the material extruded may be a large percentage of the channel width, thereby restricting flow of the ER fluid.

The maximum width of the channel may be limited by the physical space between the two chambers of the incline adjuster. If the channel is wide, the material within the middle layer may become thin and unsupported during construction, and walls of the channel may be easily dislodged. The equivalent series resistance of ER fluid will also decrease with as channel width increases, which increases the power consumption. For a shoe size range down to M7 (US) the practical width may be limited to less than 4 mm.

The desired length of the transfer channel may be a function of the maximum pressure difference between chambers of the incline adjuster when in use. The longer the channel, the greater the pressure difference that can be withstood. Optimum channel length may be application dependent and construction dependent and therefore may vary among different embodiments. A detriment of a long channel is a greater restriction to fluid flow when the electric field is removed. In some embodiments, practical limits of channel length are in the range of 25 mm to 350 mm.

As seen in FIG. 4B, incline adjuster 16 may be formed from three elements. A bottom layer 53, which may be cut from a flat sheet of thermoplastic polyurethane (TPU), forms the bottoms of chambers 35 and 36 and the bottom of transfer channel 51. Middle/spacer layer 54, which may be cut from a flat piece of hard TPU, forms the side walls of chambers 35 and 36 and of transfer channel 51. Top sheet 55, which may be formed from a flexible TPU, includes two pockets. A medial side pocket 57 forms the top and upper sidewalls of medial chamber 35. A lateral side pocket 58 forms the top and upper sidewalls of lateral chamber 36. A bottom surface of middle layer 54 may be welded or otherwise bonded to a portion of the top surface of bottom layer 53. A top surface of middle layer 54 may be welded or otherwise bonded to a portion of the bottom surface of top layer 55.

Figure 5B:
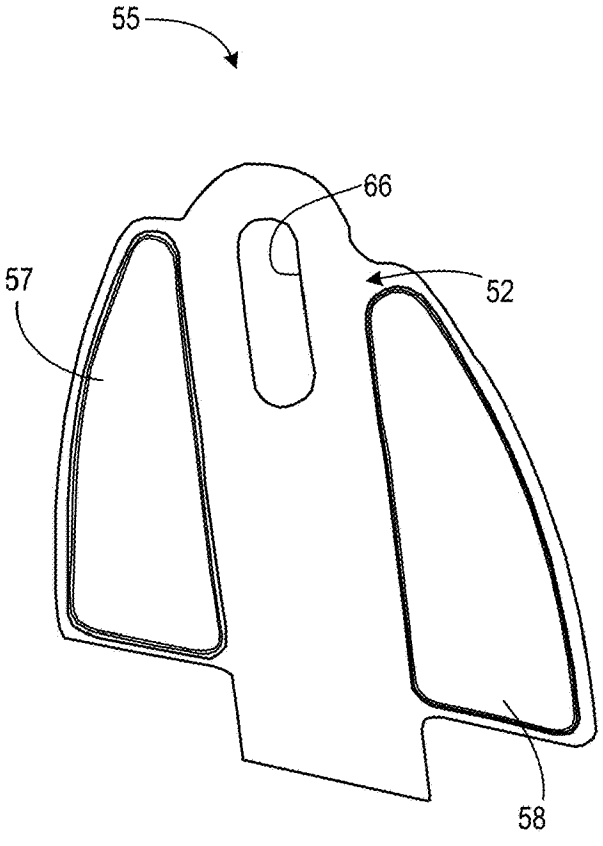
FIG. 5B is a top view of a middle layer of the incline adjuster of FIG. 4A.
Figure 5B:
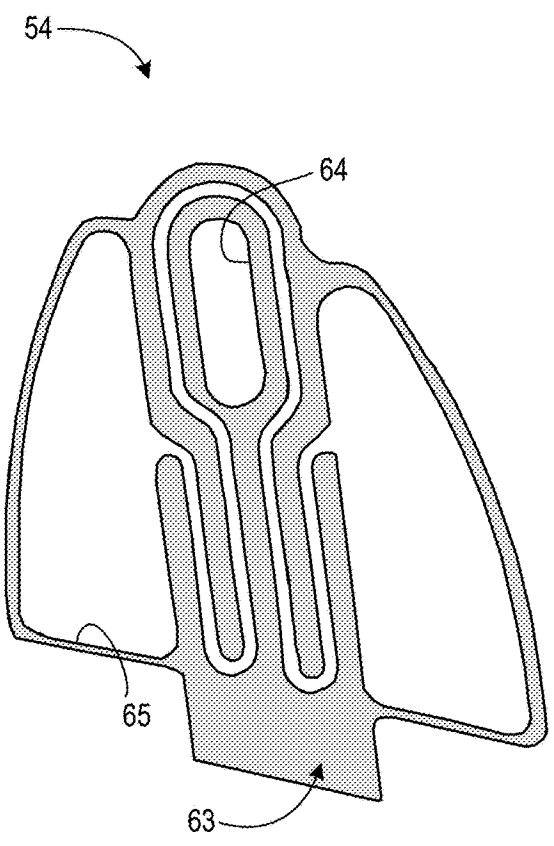
Figure 5A:
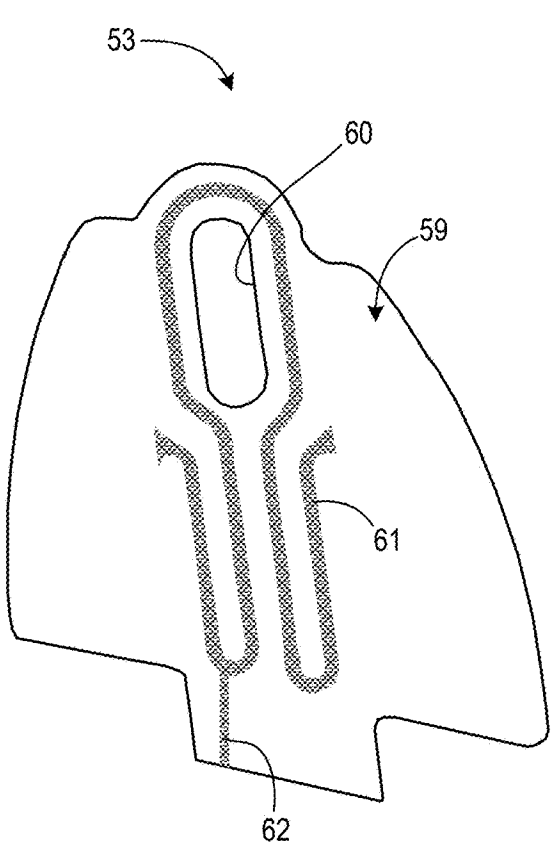
FIG. 5A is a top view of a bottom layer of the incline adjuster of FIG. 4A.

The construction of incline adjuster 16 is further understood by reference to FIGS. 5A through 5C2. FIG. 5A is a top view of bottom layer 53 showing top surface 59 of bottom layer 53. Except for an opening 60 that is part of fulcrum aperture 37, bottom layer 53 is a continuous sheet. A bottom electrode 61 is formed on the portion of top surface 59 that forms the bottom of transfer channel 51. In some embodiments, bottom electrode 61 is a span of conductive ink that has been printed onto surface 59. The conductive ink used to form bottom electrode 61 may be, e.g., an ink that comprises silver plates in a polymer matrix that includes TPU, and that bonds with the TPU of bottom layer 53 to form a flexible conductive layer. One example of such an ink is PE872 stretchable conductor available from E.I. DuPont De Nemours and Company. In addition to electrode 61, a small section 62 of conductive material is applied to surface 59 and is used to connect to electrode 61 to one of two HV DC output leads from converter 45.

FIG. 5B is a top view of middle layer 54 showing top surface 63 of middle layer 54. Middle layer 54 is a continuous piece having a first opening 64 and a second opening 65, with each of openings 64 and 65 extending from top surface 63 to the bottom surface of middle layer 54. First opening 64 is part of fulcrum aperture 37. Second opening 65 has a shape that represents the combined outlines of medial chamber 35, transfer channel 51, and lateral chamber 36 in a transverse plane of shoe 10 (after incline adjuster 16 and shoe 10 are assembled). A medial side portion of opening 65 forms side walls of medial fluid chamber 35. A center portion of opening 65 forms side walls of transfer channel 51. A lateral side portion of opening 65 forms side walls of lateral fluid chamber 36.

FIG. 5C1 is a top view of top layer 55 showing top surface 52 of top layer 55. Except for an opening 66 that is part of fulcrum aperture 37, top layer 55 is a continuous sheet. In FIG. 5C1, pockets 57 and 58 are convex structures. Medial pocket 57 is molded or otherwise formed into the sheet of top layer 55 on the medial side and forms the top and upper sidewalls of medial fluid chamber 35. Lateral pocket 58 is molded or otherwise formed into the sheet of top layer 55 on the lateral side and forms the top and upper sidewalls of lateral fluid chamber 36. In at least some embodiments, top layer 55 is formed from a relatively soft and flexible TPU that allows pockets 57 and 58 to easily collapse and expand so as to allow tops of chambers 35 and 36 to change height as ER fluid moves into and out of chambers 35 and 36.

FIG. 5C2 is a bottom view of top layer 55 showing a bottom surface 68 of top layer 55. In FIG. 5C2, pockets 57 and 58 are concave structures. A top electrode 69 is formed on the portion of bottom surface 68 that forms the top of transfer channel 51. In some embodiments, top electrode 69 is also a span of conductive ink that has been printed onto surface 68. The conductive ink used to form top electrode 69 may be the same type of ink used to form bottom electrode 61. In addition to electrode 69, a small section 70 of conductive material is applied to bottom surface 68 and is used to connect top electrode 69 to the other of the two HV DC output leads from converter 45. FIG. 5C3, a partial area cross-sectional view taken from the location indicated in FIG. 5C2, shows additional details of top electrode 69 and of pocket 58. Pocket 57 and other portions of top electrode may be similar.

Figure 6:
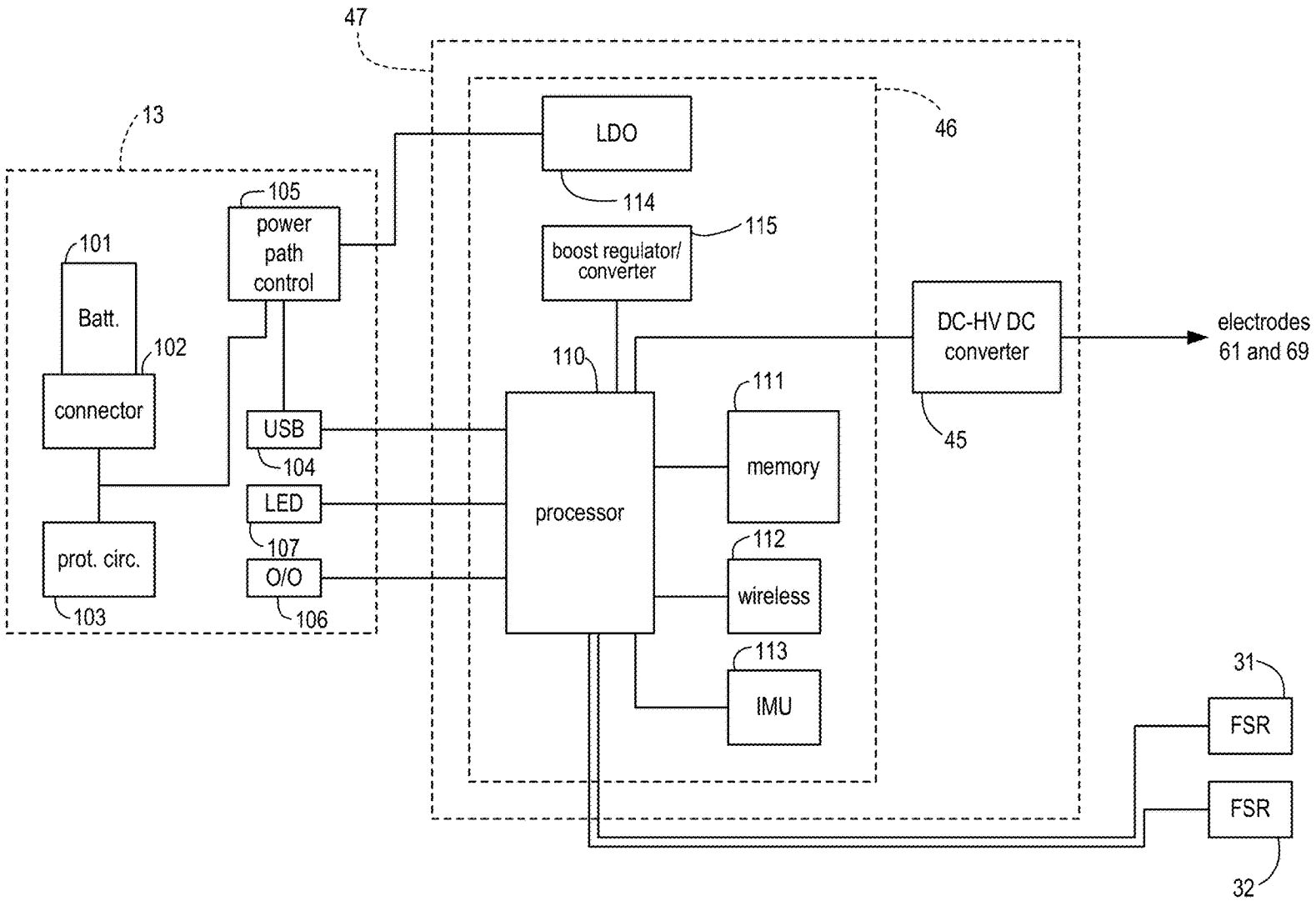
FIG. 6 is a block diagram showing electrical system components in the shoe of FIG. 1.

FIG. 6 is a block diagram showing electrical system components of shoe 10. Individual lines to or from blocks in FIG. 6 represent signal (e.g., data and/or power) flow paths and are not necessarily intended to represent individual conductors. Battery pack 13 includes a rechargeable lithium ion battery 101, a battery connector 102, and a lithium ion battery protection IC (integrated circuit) 103. Protection IC 103 detects abnormal charging and discharging conditions, controls charging of battery 101, and performs other conventional battery protection circuit operations. Battery pack 13 also includes a USB (universal serial bus) port 104 for communication with controller 47 and for charging battery 101. A power path control unit 105 controls whether power is supplied to controller 47 from USB port 104 or from battery 101. An ON/OFF (O/O) button 106 activates or deactivates controller 47 and battery pack 13. An LED (light emitting diode) 107 indicates whether the electrical system is ON or OFF. The above-described individual elements of battery pack 13 may be conventional and commercially available components that are combined and used in the novel and inventive ways described herein.

Controller 47 includes the components housed on PCB 46, as well as converter 45. In other embodiments, the components of PCB 46 and converter 45 may be included on a single PCB, or may be packaged in some other manner. Controller 47 includes a processor 110, a memory 111, an inertial measurement unit (IMU) 113, and a low energy wireless communication module 112 (e.g., a BLUETOOTH communication module). Memory 111 stores instructions that may be executed by processor 110 and may store other data. Processor 110 executes instructions stored by memory 111 and/or stored in processor 110, which execution results in controller 47 performing operations such as are described herein. As used herein, instructions may include hard-coded instructions and/or programmable instructions.

IMU 113 may include a gyroscope and an accelerometer and/or a magnetometer. Data output by IMU 113 may be used by processor 110 to detect changes in orientation and motion of shoe 10, and thus of a foot wearing shoe 10. As explained in more detail below, processor 10 may use such information to determine when an incline of a portion of shoe 10 should change. Wireless communication module 112 may include an ASIC (application specific integrated circuit) and be used to communicate programming and other instructions to processor 110, as well as to download data that may be stored by memory 111 or processor 110.

Controller 47 includes a low-dropout voltage regulator (LDO) 114 and a boost regulator/converter 115. LDO 114 receives power from battery pack 13 and outputs a constant voltage to processor 110, memory 111, wireless communication module 112, and IMU 113. Boost regulator/converter 115 boosts a voltage from battery pack 13 to a level (e.g., 5 volts) that provides an acceptable input voltage to converter 45. Converter 45 then increases that voltage to a much higher level (e.g., 5000 volts) and supplies that high voltage across electrodes 61 and 69 of incline adjuster 16. Boost regulator/converter 115 and converter 45 are enabled and disabled by signals from processor 110. Controller 47 further receives signals from medial FSR 31 and from lateral FSR 32. Based on those signals from FSRs 31 and 32, processor 110 determines whether forces from a wearer foot on medial fluid chamber 35 and on lateral fluid chamber 36 are creating a pressure within chamber 35 that is higher than a pressure within chamber 36, or vice versa.

The above-described individual elements of controller 47 may be conventional and commercially available components that are combined and used in the novel and inventive ways described herein. Moreover, controller 47 is physically configured, by instructions stored in memory 111 and/or processor 110, to perform the herein described novel and inventive operations in connection with controlling transfer of fluid between chambers 35 and 36 so as to adjust the incline of the forefoot portion of the shoe 10 footbed 14.

FIGS. 7A through 7D are partially schematic area cross-sectional diagrams showing operation of incline adjuster 16, according to some embodiments, when going from a minimum incline condition to a maximum incline condition. In the minimum incline condition, an incline angle $\alpha$ of the top plate relative to the bottom plate has a value of $\alpha_{min}$ representing a minimum amount of incline sole structure 12 is configured to provide in the forefoot region. In some embodiments, $\alpha_{min}=0°$. In the maximum incline condition, the incline angle $\alpha$ has a value of $\alpha_{max}$ representing a maximum amount of incline sole structure 12 is configured to provide. In some embodiments, $\alpha_{max}$ is at least 5°. In some embodiments, $\alpha_{max}=10°$. In some embodiments, $\alpha_{max}$ may be greater than 10°.

In FIGS. 7A-7D, bottom plate 29, incline adjuster 16, top plate 41, FSR 31, FSR 32, and fulcrum element 34 are represented, but other elements are omitted for simplicity. FIG. 7E is a top view of incline adjuster 16 (in a minimum incline condition) and bottom plate 29 showing the approximate locations of the sectioning lines corresponding to the views of FIGS. 7A-7D. Top plate 41 is omitted from FIG. 7E, but the peripheral edge of top plate 41 would generally coincide with that of bottom plate 29 if top plate 41 were included in FIG. 7E. Although fulcrum element 34 would not appear in an area cross-section according to the section lines of FIG. 7E, the general position of fulcrum element 34 relative to the medial and lateral sides of other elements in FIGS. 7A-7D is indicated with broken lines.

Also indicated in FIGS. 7A through 7D are a lateral side stop 123 and a medial side stop 122. Medial side stop 122 supports the medial side of top plate 41 when incline adjuster 16 and top plate 41 are in the maximum incline condition. Lateral side stop 123 supports the lateral side of top plate 41 when incline adjuster 16 and top plate 41 are in the minimum incline condition. Lateral side stop 123 prevents top plate 41 from tilting toward the lateral side. Because runners proceed around a track in a counterclockwise direction during a race, a wearer of shoe 10 will be turning to his or her left when running on curved portions of a track. In such a usage scenario, there would be no need to incline the footbed of a right shoe sole structure toward the lateral side. In other embodiments, however, and as discussed below, a sole structure may be tiltable to either medial or lateral side.

In some embodiments, a left shoe from a pair that includes shoe 10 may be configured in a slightly different manner from what is shown in FIGS. 7A-7D. For example, a medial side stop may be at a height similar to that of lateral side stop 123 of shoe 10, and a lateral side stop may be at a height similar to that of medial side stop 122 of shoe 10. In such embodiments, the top plate of the left shoe moves between a minimum incline condition and maximum incline condition in which the top plate is inclined to the lateral side.

The locations of lateral side stop 123 and of medial side stop 122 are represented schematically in FIGS. 7A-7D, and are not shown in previous drawing figures. In some embodiments, lateral side stop 123 may be formed as a rim on the lateral side or edge of bottom plate 29. Similarly, medial side stop 122 my be formed as a rim on the medial side or edge of bottom plate 29.

Figure 7A:
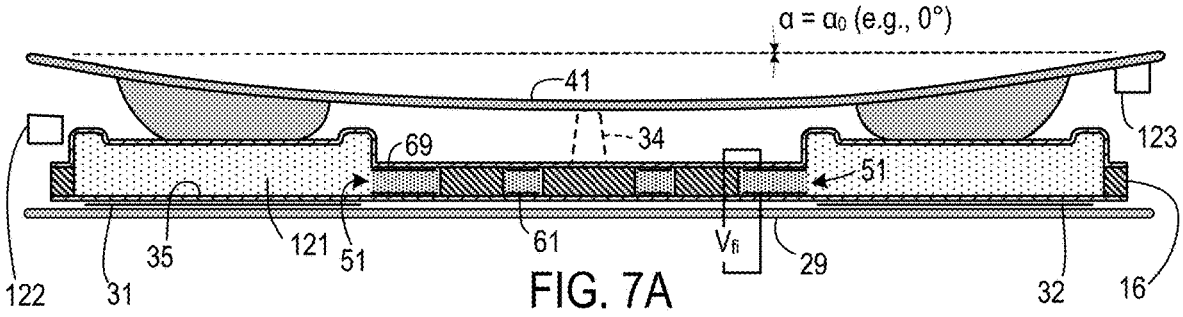
FIGS. 7A through 7D are partially schematic area cross-sectional diagrams showing operation of the incline adjuster of the shoe of FIG. 1 when going from a minimum incline condition to a maximum incline condition.

FIG. 7A shows incline adjuster 16 when top plate 41 is in a minimum incline condition. Shoe 10 may be configured to place top plate 41 into the minimum incline condition when a wearer of shoe 10 is standing or is in starting blocks about to begin a race, or when the wearer is running a straight portion of a track. In FIG. 7A, controller 47 is maintaining the voltage across electrodes 61 and 69 at one or more flow-inhibiting voltage levels ($V=V_{fi}$). In particular, the voltage across electrodes 61 and 69 is high enough to generate an electrical field having a strength sufficient to increase the viscosity of ER fluid 121 in transfer channel 51 to a viscosity level that prevents flow out of or into chambers 35 and 36. In some embodiments, a flow-inhibiting voltage level $V_{fi}$ is a voltage sufficient to create a field strength between electrodes 61 and 69 of between 3 kV/mm and 6 kV/mm. In FIGS. 7A through 7D, light stippling is used to indicate ER fluid 121 having a viscosity that is at a normal viscosity level, i.e., unaffected by an electrical field. Dense stippling is used to indicate ER fluid 121 in which the viscosity has been raised to a level that blocks flow through channel 51. Because ER fluid 121 cannot flow through channel 51 under the conditions shown in FIG. 7A, the incline angle $\alpha$ of top plate 41 does not change if the wearer of shoe 10 shifts weight between medial and lateral sides of shoe 10.

Figure 7B:
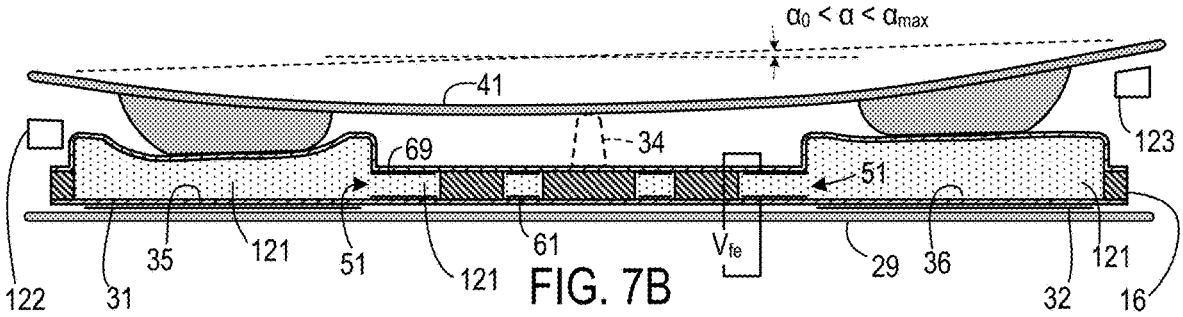

FIG. 7B shows incline adjuster 16 soon after controller 47 has determined that top plate 41 should be placed into the maximum incline condition, i.e., inclined to $\alpha=\alpha_{max}$. In some embodiments, and as explained below, controller 47 makes such a determination based on a number of steps taken by the shoe 10 wearer. Upon determining that top plate 41 should be inclined to $\alpha_{max}$, controller 47 determines if the foot wearing shoe 10 is in a portion of the wearer gait cycle in which shoe 10 is in contact with the ground. Controller 47 also determines if a difference $\Delta P_{M-L}$ between the pressure $P_M$ of ER fluid 121 in medial side chamber 35 and the pressure $P_L$ of ER fluid 121 in lateral side chamber 36 is positive, i.e., if $P_M-P_L$ is greater than zero. If shoe 10 is in contact with the ground and $\Delta P_{M-L}$ is positive, controller 47 reduces the voltage across electrodes 61 and 69 to a flow-enabling voltage level $V_{fe}$. In particular, the voltage across electrodes 61 and 69 is reduced to a level that is low enough to reduce the strength of the electrical field in transfer channel 51 so that the viscosity of ER fluid 121 in transfer channel 51 is at a normal viscosity level.

Upon reducing the voltage across electrodes 61 and 69 to a $V_{fe}$ level, the viscosity of ER fluid 121 in channel 51 drops. ER fluid 121 then begins flowing out of chamber 35 and into chamber 36. This allows the medial side of top plate 41 to begin moving toward bottom plate 29, and the lateral side of top plate 41 to begin moving away from bottom plate 29. As a result, the incline angle $\alpha$ begins to increase from $\alpha_{min}$.

In some embodiments, controller 47 determines if shoe 10 is in a step portion of the gait cycle and in contact with the ground based on data from IMU 113. In particular, IMU 113 may include a three-axis accelerometer and a three-axis gyroscope. Using data from the accelerometer and gyroscope, and based on known biomechanics of a runner foot, e.g., rotations and accelerations in various directions during different portions of a gait cycle, controller 47 can determine whether the right foot of the shoe 10 wearer is stepping on the ground. Controller 47 may determine if $\Delta P_{M-L}$ is positive based on the signals from FSR 31 and FSR 32. Each of those signals corresponds to magnitude of a force from a wearer foot pressing down on the FSR. Based on the magnitudes of those forces and on the known dimensions of chambers 35 and 36, controller 47 can correlate the values of signals from FSR 31 and FSR 32 to a magnitude and a sign of $\Delta P_{M-L}$.

Figure 7C:
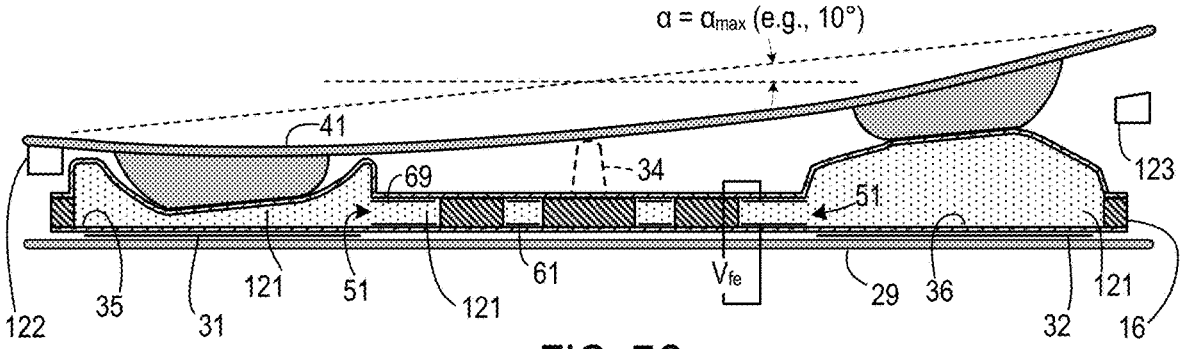
Figure 7D:
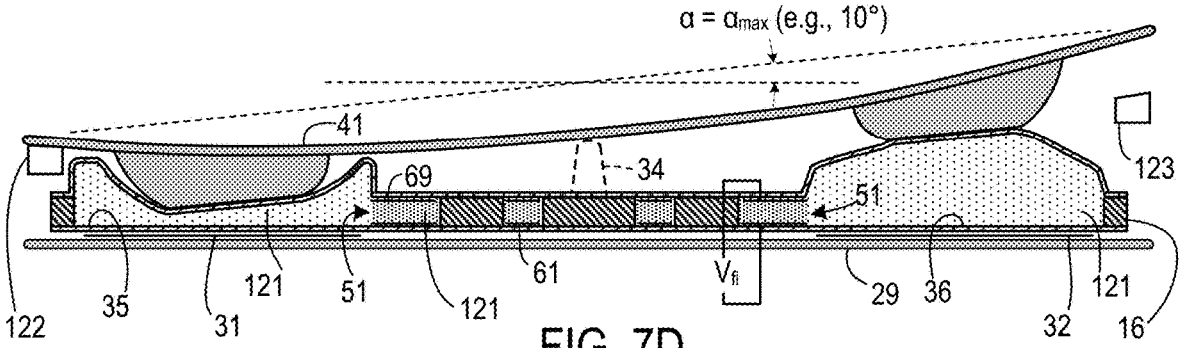
Figure 7E:
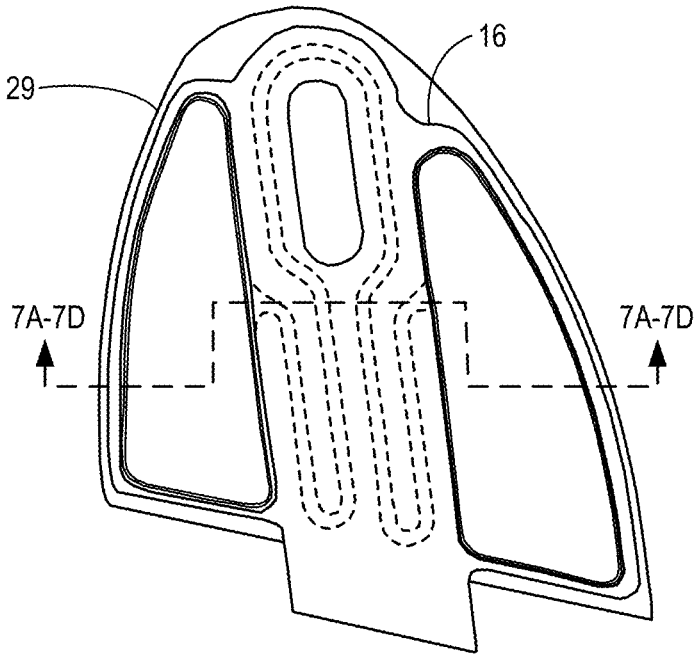
FIG. 7E is a top view of the incline adjuster and a bottom plate of the shoe of FIG. 1, and showing the approximate locations of sectioning lines corresponding to the views of FIGS. 7A-7D.

FIG. 7C shows incline adjuster 16 very soon after the time associated with FIG. 7B. In FIG. 7C, top plate 41 has reach the maximum incline condition. In particular, the incline angle $\alpha$ of top plate 41 has reached $\alpha_{max}$. Medial stop 122 prevents incline angle $\alpha$ from exceeding $\alpha_{max}$. FIG. 7D shows incline adjuster 16 very soon after the time associated with FIG. 7C. In FIG. 7D, controller 47 has raised the voltage across electrodes 61 and 69 to a flow-inhibiting voltage level $V_{fi}$. This prevents further flow through transfer channel 51 and holds top plate 41 in the maximum incline condition. During a normal gait cycle, downward force of a right foot on a shoe is initially higher on the lateral side as the forefoot rolls to the medial side. If flow through channel 51 were not prevented, the initial downward force on the lateral side of the wearer right foot would decrease incline angle $\alpha$.

Figure 8A:
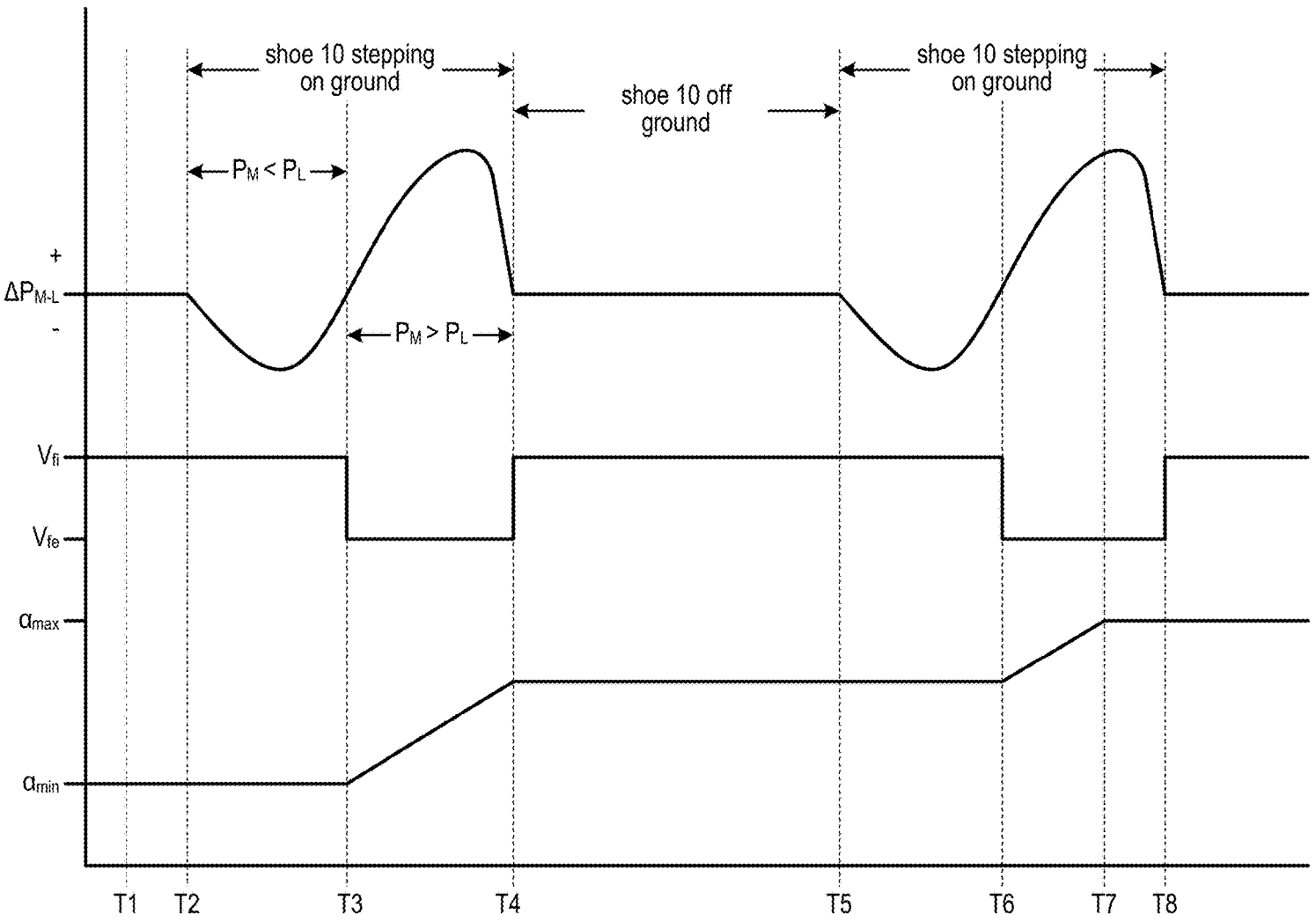
FIG. 8A is a graph of foot position, pressure difference, voltage levels, and incline angle at different times during a transition from a minimum incline condition to a maximum incline condition.

In some embodiments, a wearer of shoe 10 may be required to take several steps in order for top plate 41 to reach maximum incline. Accordingly, controller 47 may be configured to raise the voltage across electrodes 61 and 69 when controller 47 determines (based on data from IMU 113 and FSRs 31 and 32) that the wearer foot has left the ground. Controller 47 may then drop that voltage when it again determines that shoe 10 is stepping on the ground and $\Delta P_{M-L}$ is positive. This can be repeated for a predetermined number of steps. This is illustrated in FIG. 8A, a graph of medial-lateral pressure difference $\Delta P_{M-L}$, voltage across electrodes 61 and 69, and incline angle $\alpha$ at different times during a transition from a minimum incline condition to a maximum incline condition.

At time T1, controller 47 determines that top plate 41 of shoe 10 should transition to the maximum incline condition. At time T2, controller 47 determines that shoe 10 is stepping on the ground, but that $\Delta P_{M-L}$ is negative. At time T3, controller 47 determines that shoe 10 is stepping on the ground and that $\Delta P_{M-L}$ is positive, and controller reduces the voltage across electrodes 61 and 69 to $V_{fe}$. As a result, incline angle $\alpha$ of top plate 41 begins to increase from $\alpha_{min}$. At time T4, controller 47 determines that shoe 10 is no longer stepping on the ground, and controller raises the voltage across electrodes 61 and 69 to $V_{fi}$. As a result, incline angle $\alpha$ holds at its current value. At time T5, controller 47 again determines that shoe 10 is stepping on the ground, but that $\Delta P_{M-L}$ is negative. At time T6, controller 47 determines that shoe 10 is stepping on the ground and that $\Delta P_{M-L}$ is positive, controller 47 again reduces the voltage across electrodes 61 and 69 to $V_{fe}$, and incline angle $\alpha$ resumes increasing. At time T7, incline angle $\alpha$ reaches $\alpha_{max}$. Incline angle $\alpha$ stops increasing because further tilting of top plate 41 is prevented by medial stop 122. At time T8, controller 47 determines that shoe 10 is no longer stepping on the ground, and controller 47 again raises the voltage across electrodes 61 and 69 to $V_{fi}$. Controller 47 maintains that voltage at $V_{fi}$ through further step cycles until controller 47 determines that top plate 41 should transition to the minimum incline condition.

Figure 8B:
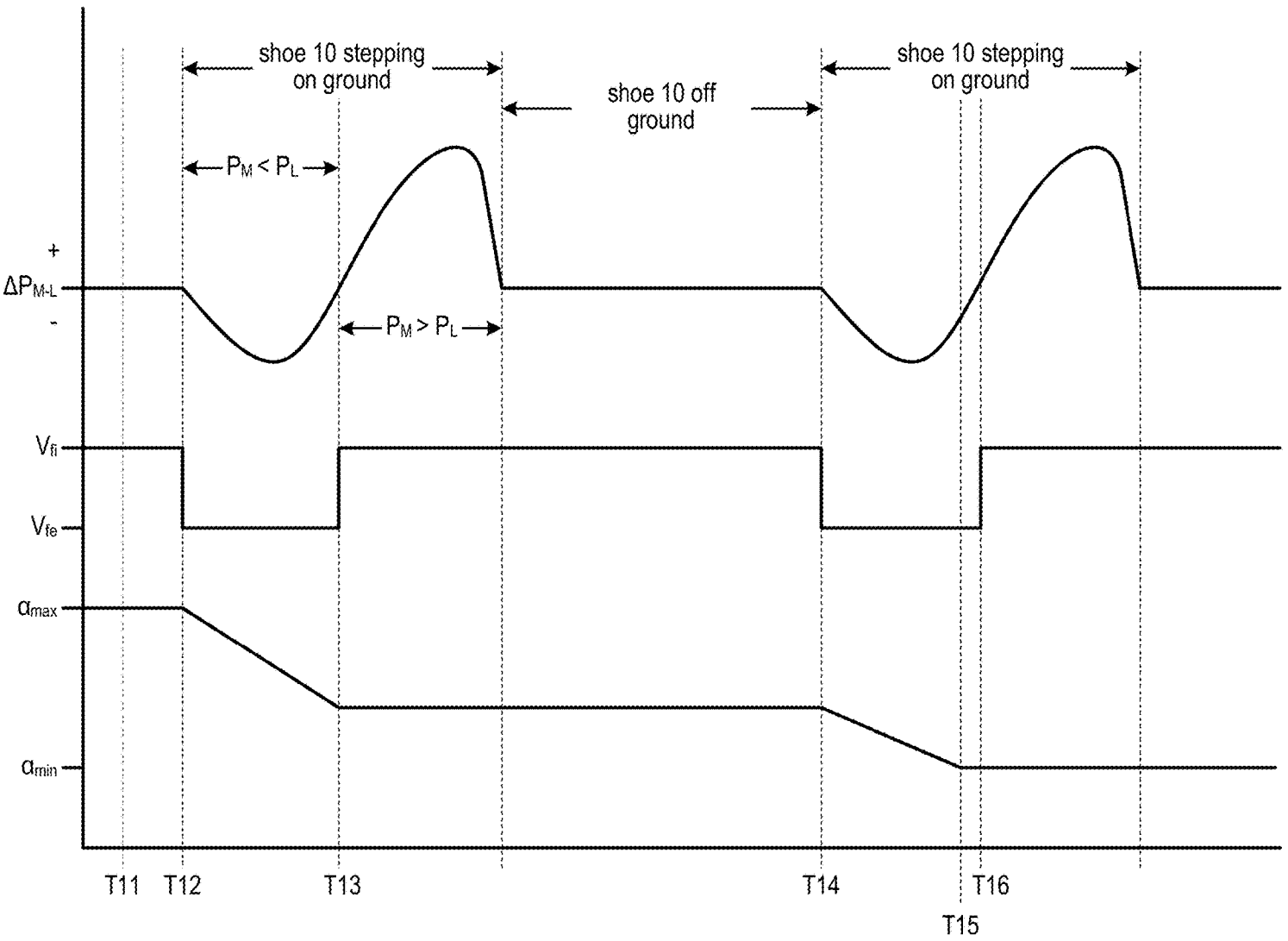
FIG. 8B is a graph of foot position, pressure difference, voltage levels, and incline angle at different times during a transition from a maximum incline condition to a minimum incline condition.

FIG. 8B is a graph of medial-lateral pressure difference $\Delta P_{M-L}$, voltage across electrodes 61 and 69, and incline angle $\alpha$ at different times during a transition from a minimum incline condition to a maximum incline condition. At time T11, controller 47 determines that top plate 47 of shoe 10 should transition to the minimum incline condition. At time T12, controller 47 determines that shoe 10 is stepping on the ground and that $\Delta P_{M-L}$ is negative, and controller 47 decreases the voltage across electrodes 61 and 69 to $V_{fe}$. As a result, and because a negative $\Delta P_{M-L}$ represents a pressure $P_{lat}$ in lateral chamber 36 that is higher than a pressure $P_{med}$ in medial chamber 35, ER fluid 121 begins to flow out of lateral chamber 36 and into medial chamber 35, and incline angle $\alpha$ begins to decrease from $\alpha_{max}$. At time T13, controller 47 determines that shoe 10 is stepping on the ground but that $\Delta P_{M-L}$ is positive, and controller 47 increases the voltage across electrodes 61 and 62 to $V_{fi}$. As a result, incline angle $\alpha$ of top plate 41 holds. At time T14, controller 47 determines that shoe 10 is again stepping on the ground and that $\Delta P_{M-L}$ is negative, and controller 47 lowers the voltage across electrodes 61 and 69 to $V_{fe}$. As a result, incline angle $\alpha$ continues to decrease. At time T15, incline angle $\alpha$ reaches $\alpha_{min}$. Incline angle $\alpha$ stops decreasing because further tilting of top plate 41 is prevented by lateral stop 123.

At time T16, controller 47 determines that $\Delta P_{M-L}$ is positive, and controller 47 again increases the voltage across electrodes 61 and 69 to $V_{fi}$. Controller 47 maintains that voltage at $V_{fi}$ through further step cycles until controller 47 determines that top plate 41 should transition to the maximum incline condition.

In the above example, controller 47 lowered the voltage across electrodes 61 and 69 during two step cycles to transition between incline conditions. In other embodiments, however, controller 47 may lower that voltage during fewer or more step cycles. The number of step cycles to transition from minimum incline to maximum incline may not be the same as the number of step cycles to transition from maximum incline to minimum incline.

Figure 9A:
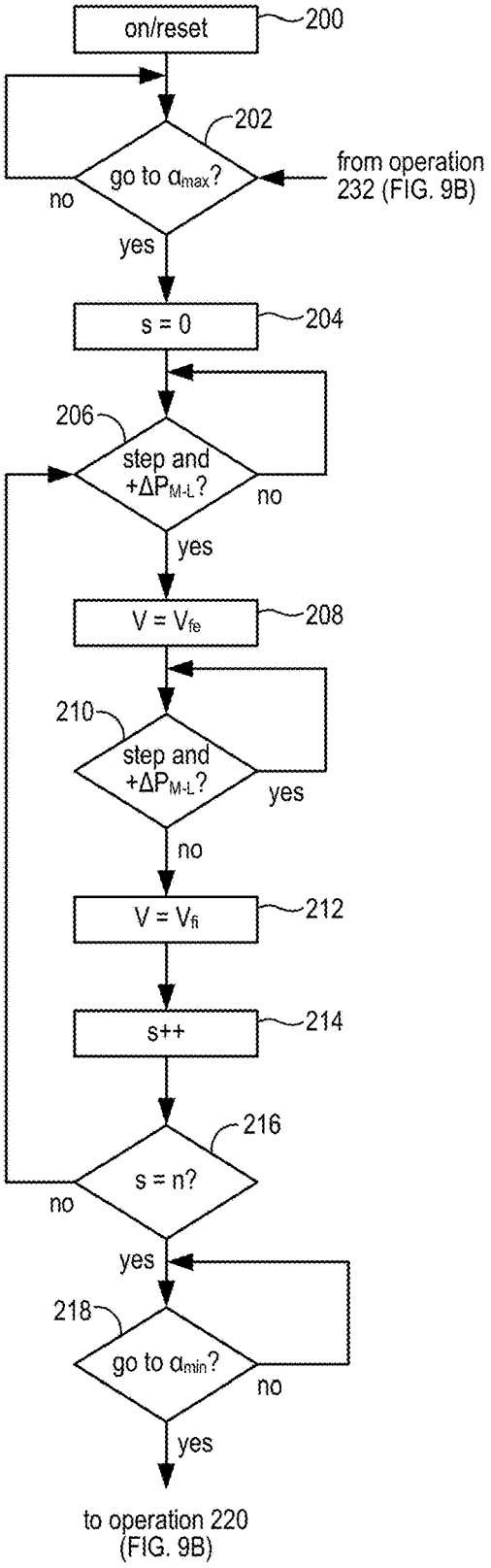
FIGS. 9A and 9B are a flow chart showing operations performed by a controller of the shoe of FIG. 1 according to some embodiments.
Figure 9B:
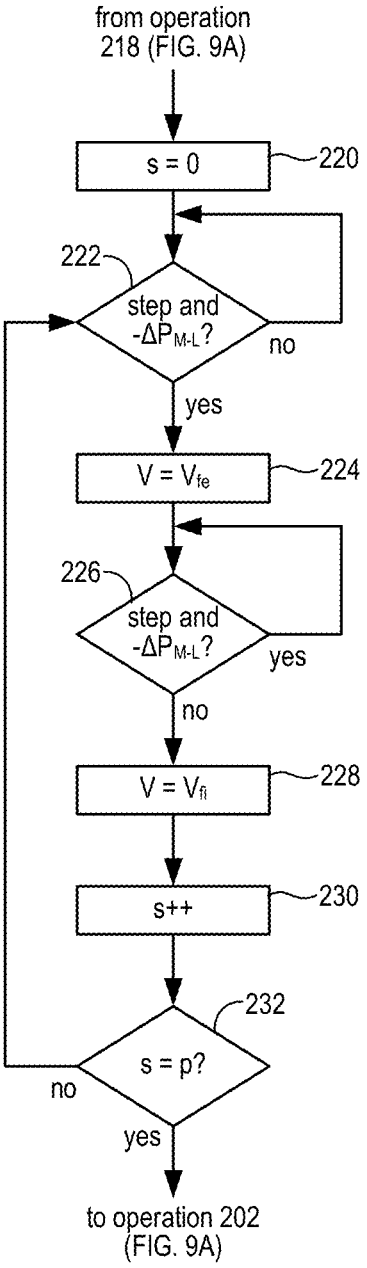

FIGS. 9A and 9B are a flow chart showing operations performed by controller 47 according to some embodiments. In operation 200, ON/OFF button 106 (FIG. 6) is pressed and controller 47 is powered, and controller 47 performs an initialization routine. In some embodiments, for example, controller 47 may reduce the voltage across electrodes 61 and 69 to $V_{fe}$ until ON/OFF button 106 pressed a second time. An athlete can don shoe 10, press button 106 a first time, stand flat footed for a moment, and then press button 106 a second time. In this manner, shoe 10 is initialized with top plate 41 in the minimum incline condition.

In operation 202, controller 47 determines if top plate 41 should transition from minimum to maximum incline, e.g., if the location of shoe 10 indicates travel of a distance from the location of initialization at operation 200 and that corresponds to a location (e.g., track bend) at which inline is desirable. In some embodiments, controller 47 makes the determination of operation 202 by counting the number of steps taken since initialization, and determining if that number of steps is enough to have located the shoe 10 wearer in a portion of a track bend. Typically, track athletes are very consistent in the lengths of their strides. Track dimensions and distances from the starting line to the bends in each track lane are known quantities that can be stored by controller 47. Based on input from a shoe 10 wearer to controller 47 indicating the track lane assigned to that shoe 10 wearer, as well as input indicating the length of that wearer's stride, controller 47 can determine the wearer's track location by keeping a running count of steps taken. As discussed above, controller 47 can determine where shoe 10 may be within a gait cycle based on data from IMU 113. These gait cycle determinations can indicate when a step has been taken.

If controller 47 determines that top plate 41 should not transition from minimum to maximum incline, controller 47 loops back to operation 202 on the "no" branch. Otherwise, controller 47 proceeds on the "yes" branch to operation 204 and initializes a step counter s to zero. Step counter s is distinct from the above-mentioned count of steps since initialization that controller 47 maintains.

In operation 206, controller 47 determines if shoe 10 is stepping on the ground and if $\Delta P_{M-L}$ is positive. If either requirement is unmet, controller 47 repeats operation 206 in the "no" branch. If both requirements are met, controller 47 proceeds on the "yes" branch to operation 208 and reduces the voltage across electrodes 61 and 69 to $V_{fe}$. Controller 47 then continues to operation 210 and determines if shoe 10 is still stepping on the ground and if $\Delta P_{M-L}$ is still positive. If both requirements are met, controller 47 repeats operation 210 on the "yes" branch. If one or both requirements is not met, controller 47 proceeds on the "no" branch to operation 212, where controller 47 raises the voltage across electrodes 61 and 69 to $V_{fi}$. Controller 47 then increments the s (step) counter in operation 214.

Controller 47 next proceeds to operation 216 and determines if s=n, where n is the number of steps during which voltage across electrodes 61 and 69 will be dropped during the transition from minimum incline to maximum incline. In the example of FIG. 8A, for example, n=2. In some embodiments, n may be a parameter that a user can adjust. For example, lighter wearers of shoe 10 may require 3 steps to fully transition between incline conditions.

If controller 47 determines in operation 216 that s does not equal n, controller 47 returns to operation 206 on the "no" branch. Otherwise, controller 47 continues to operation 218 on the "yes" branch. In operation 218, controller 47 determines if top plate 41 should transition back to the minimum incline condition, e.g., if the wearer has traveled a distance from the initialization location that corresponds to a straight portion of a track. In some embodiments, controller 47 makes the determination of operation 218 based on number of steps taken since initialization, stride length, and the track lane assigned to the shoe 10 wearer. If controller 47 determines a transition is not required, operation 218 is repeated ("no" branch"). If a transition is required, controller 47 proceeds on the "yes" branch to operation 220 (FIG. 9B).

In operation 220, controller 47 resets the s counter to 0. In operation 222 controller 47 determines if shoe 10 is stepping on the ground and if $\Delta P_{M-T}$ is negative. If both tests are not satisfied, controller 47 repeats operation 222 ("no branch"). If both tests are satisfied, controller 47 proceeds to operation 224 and reduces voltage across electrodes 61 and 69 to $V_{fe}$. Controller 47 then determines in operation 226 whether shoe 10 is still stepping on the ground and whether $\Delta P_{M-T}$ is still negative. If both tests are satisfied, controller 47 repeats operation 226 ("yes" branch). Otherwise, controller 47 proceeds on the "no" branch to operation 228 and raises the voltage across electrodes 61 and 62 to $V_{fi}$. Controller 47 then increments the s counter in operation 230 and continues to operation 232. In operation 232, controller 47 determines if s=p, where p is the number of steps during which voltage across electrodes 61 and 69 will be dropped during the transition from maximum incline to minimum incline. In the example of FIG. 8B, for example, p=2. In some embodiments, p may also be a parameter that a user can adjust. The value of p need not be the same as n. If s is not equal to p, controller 47 returns to operation 222 on the "no" branch. If s=p, controller 47 returns to operation 202 (FIG. 9A) on the "yes" branch.

In some embodiments, a left shoe of the pair that includes shoe 10 may operate in a manner similar to that described above for shoe 10, but with a maximum incline condition representing a maximum inclination of the left shoe top plate toward the lateral side. Operations performed by the left shoe controller would be similar to those described above in connection with FIGS. 8A through 9B, but with determinations based on the sign of $\Delta P_{M-L}$ instead based on the sign of $\Delta P_{L-M}=P_L-P_M$, where $P_L$ is a pressure in the left shoe lateral fluid chamber and $P_M$ is a pressure in the left shoe medial fluid chamber.

In some embodiments, a shoe may be similar to shoe 10, but may lack medial and/or lateral stops such as stops 122 and 123 (FIGS. 7A-7D). In some such embodiments, the minimum incline angle $\alpha_{min}$ and the maximum incline angle $\alpha_{max}$ may be adjustable parameters that a user may input to the controller. In addition, the shoe may include one or more tilt sensors configured to output signals indicative of the incline angle of the top plate. Such tilt sensors could be, e.g., one or MEMS sensors that measures distance between the top and bottom plates or encoders measuring the rotational angle between the top and bottom plates.

Figure 10A:
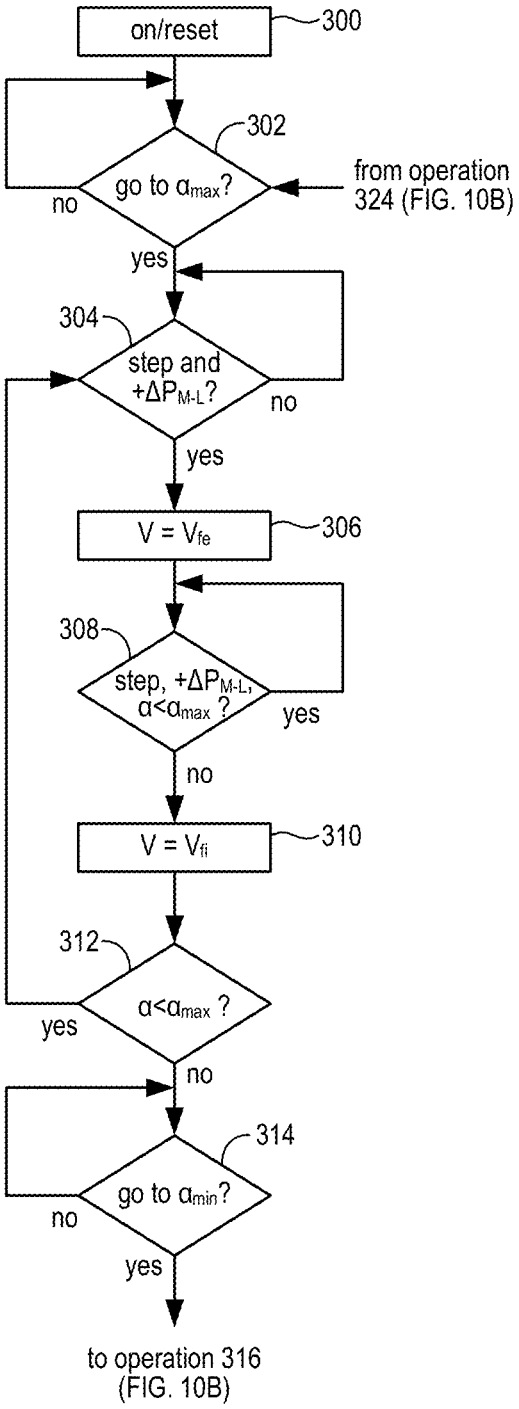
FIGS. 10A and 10B are a flow chart showing operations performed by a controller of a shoe according to some additional embodiments.
Figure 10B:
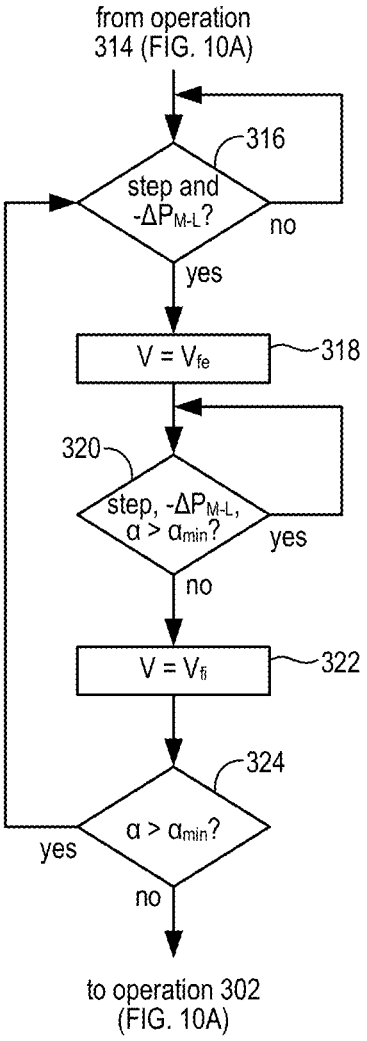

FIGS. 10A and 10B are a flow chart showing operations performed by a controller of a right shoe according to some embodiments in which minimum incline angle $\alpha_{min}$ and the maximum incline angle $\alpha_{max}$ may be adjustable parameters. In operation 300, the controller performs an initialization routine similar to that described in connection with operation 200 of FIG. 9A. In operation 302, the controller determines if a transition to maximum incline is required. If not, the controller repeats operation 302 ("no" branch); if so, the controller proceeds to operation 304 ("yes" branch). Operation 302 may be performed in a manner similar to operation 202 in FIG. 9A.

In operation 304, the controller determines if the shoe is stepping on the ground and if $\Delta P_{M-T}$ is positive. If not, operation 304 is repeated ("no" branch). If both tests are satisfied, the controller continues to operation 306 and sets a voltage across incline adjuster electrodes to $V_{fe}$. The controller then continues to operation 308 and determines if (a) the shoe is still stepping on the ground, (b) $\Delta P_{M-T}$ is still positive, and (c) the incline angle $\alpha$ of the shoe top plate is less than $\alpha_{max}$. If tests (a), (b), and (c) are all satisfied, the controller repeats operation 308 ("yes" branch). If one or more of tests (a), (b), and (c) is not satisfied, the controller proceeds on the "no" branch to operation 310 and raises the incline adjuster electrode voltage to $V_{fi}$. The controller then proceeds to operation 312 and determines if the incline angle $\alpha$ of the shoe top plate is less than $\alpha_{max}$. If the incline angle $\alpha$ of the shoe top plate is less than $\alpha_{max}$, the controller returns to operation 304 ("yes" branch). Otherwise, the controller proceeds on the "no" branch to operation 314 and determines if the shoe top plate should transition to the minimum incline condition (e.g., if steps since initialization represents a distance corresponding to the end of track bend). If not, operation 314 is repeated ("no" branch). If so, the controller proceeds on the "yes" branch to operation 316 (FIG. 10B).

In operation 316, the controller determines if the shoe is stepping on the ground and if $\Delta P_{M-T}$ is negative. If both tests are not satisfied, the controller repeats operation 316 ("no" branch). If both steps are satisfied, the controller proceeds on the "yes" branch to operation 318 and raises the incline adjuster electrode voltage to $V_{fe}$. The controller then continues to operation 320 and determines whether (a) the shoe is still stepping on the ground, (b) $\Delta P_{M-T}$ is still negative, and (c) the incline angle $\alpha$ of the shoe top plate is greater than $\alpha_{min}$. If tests (a), (b), and (c) are all satisfied, the controller repeats operation 320 ("yes" branch). If one or more of tests (a), (b), and (c) is not satisfied, the controller proceeds on the "no" branch to operation 322 and raises the incline adjuster electrode voltage to $V_{fi}$. The controller then continues to operation 324 and determines if the incline angle $\alpha$ of the shoe top plate is greater than $\alpha_{min}$. If so, the controller returns to operation 316 ("yes" branch). Otherwise, the controller returns to operation 302 (FIG. 10B) on the "no" branch.

As indicated above, FIGS. 10A and 10B describe operations that could be performed by a controller in a right shoe. That right shoe may be part of a pair that includes a left shoe that also lacks medial and lateral stops and that includes incline sensors, and that further includes a controller configured to perform operations similar to those described in FIGS. 10A and 10B, but with determinations in operations 308, 312, 320, and 324 based on $\Delta P_{L-M}$ instead of $\Delta P_{M-L}$.

In some embodiments, a right shoe similar to shoe 10 may be configurable to incline a top plate toward a lateral side, and a left shoe similar to shoe 10 may be configurable to include a top plate toward a medial side. In some such embodiments, the shoes lack medial and lateral stops similar to stops 122 and 123. Those shoes may further include sensors that detect top plate incline angle and may include controllers configured to perform operations similar to those described in connection with FIGS. 10A and 10B, but where direction of tilt is an additional user-programmable parameter. If the user programs that parameter for the right shoe top plate to incline to the medial side, the operations of FIGS. 10A and 10B would be performed by the right shoe controller. If the user programs that parameter for the right shoe top plate to incline to the lateral side, the operations performed by the right shoe controller would be similar to those of FIGS. 10A and 10B, but with determinations of operations 308, 312, 320, and 324 based on $\Delta P_{L-M}$ instead of $\Delta P_{M-L}$. If the user programs that parameter for the left shoe top plate to incline to the medial side, the operations of FIGS. 10A and 10B would be performed by the left shoe controller. If the user programs that parameter for the left shoe top plate to incline to the lateral side, the operations performed by the left shoe controller would be similar to those of FIGS. 10A and 10B, but with determinations of operations 308, 312, 320, and 324 based on $\Delta P_{L-M}$ instead of $\Delta P_{M-L}$.

In some embodiments, a shoe controller may determine when to transition from minimum incline to maximum incline, and vice versa, based on other types of inputs. In some such embodiments, for example, a shoe wearer may wear a garment that includes one or more IMUs located on the wearer's torso and/or at some other location displaced from the shoe. Output of those sensors could be communicated to the shoe controller over a wireless interface similar to wireless module 112 (FIG. 6). Upon receiving output from those sensors indicating that the wearer has a assumed a body position consistent with a need to incline a shoe top plate (e.g., as the wearer's body tilts to the side when running on a track bend), the controller can perform operations to incline a shoe top plate. In still other embodiments, a shoe controller may determine location in some other manner (e.g., based on GPS signals).

In some embodiments, a shoe may include an incline adjuster and other components that are configured to incline a different portion of a shoe footbed. As but one example, a basketball shoe may include an incline adjuster similar to incline adjuster 16, but having one chamber positioned in a medial midfoot or heel region, and another chamber positioned in a lateral midfoot or heel region, and with shapes of the chambers modified to match those positions. A controller of such a shoe could be configured to perform operations similar to those described above upon determining that a wearer's body position corresponds to a need to incline the midfoot and/or heel, and upon determining that such inclination is no longer needed. When cutting to the left, for example, a right shoe having a midfoot and heel region inclined medially could provide additional support and stability. A controller could be configured to determine that a cutting motion is occurring based on position and/or movement of the wearer's torso, and/or based on a sudden increase in pressure on a medial side of the shoe, and/or based on sensors located within an upper that indicate the heel region has tilted relative to the forefoot region.

A controller need not be located within a sole structure. In some embodiments, for example, some or all components of a controller could be located with the housing of a battery assembly such as battery assembly 13 and/or in another housing positioned on a footwear upper.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the claims, a reference to a potential or intended wearer or a user of a component does not require actual wearing or using of the component or the presence of the wearer or user as part of the claimed invention.

For the avoidance of doubt, the present application includes the subject-matter described in the following numbered paragraphs (referred to as "Para" or "Paras"):

1. A sole structure for an article of footwear comprising a footbed; a first chamber positioned under and supporting a first portion of the footbed, the first chamber containing an electrorheological fluid and having a height that varies in response to transfer of the electrorheological fluid into and out of the first chamber; a second chamber positioned under and supporting a second portion of the footbed, the second chamber containing the electrorheological fluid and having a height that varies in response to transfer of the electrorheological fluid into and out of the second chamber; a transfer channel in fluid communication with interiors of the first and second chambers and containing the electrorheological fluid; electrodes positioned to create, in response to a voltage across the electrodes, an electrical field in at least a portion of the electrorheological fluid in the transfer channel; and a controller including a processor and memory, at least one of the processor and memory storing instructions executable by the processor to perform operations that include maintaining the voltage across the electrodes at one or more flow-inhibiting levels at which flow of the electrorheological fluid the through the transfer channel is blocked, and that further include maintaining the voltage across the electrodes at one or more flow-enabling levels permitting flow of the electrorheological fluid through the transfer channel.
2. The sole structure of Para 1, wherein each of the first and second chambers comprises at least one flexible wall.
3. The sole structure of Para 1 or 2, wherein the transfer channel has a serpentine shape.
4. The sole structure of any preceding Para, wherein the transfer channel includes multiple sections changing direction by 180°.
5. The sole structure of any preceding Para, wherein the first and second portions of the footbed are in a forefoot region.
6. The sole structure of any preceding Para, further comprising a support plate positioned under the first and the second chambers and above an outsole.
7. The sole structure of any preceding Para, further comprising a support plate positioned above the first and the second chambers and under the first and second portions of the footbed.
8. The sole structure of any preceding Para, further comprising a pivot element positioned between the first and the second chambers and under the footbed, wherein the pivot element is less compressible than the first and the second chambers when flow of electrorheological fluid through the transfer channel is permitted.
9. The sole structure of any preceding Para, wherein the electrodes are located on inner walls of the transfer channel.
10. The sole structure of any preceding Para, wherein the electrodes comprise conductive ink printed on inner walls of the transfer channel.
11. The sole structure of any preceding Para, further comprising a flexible polymer sheet forming at least a portion of a top and portions of a sidewall of the first chamber and at least a portion of a top and portions of a sidewall of the second chamber.
12. The sole structure of any preceding Para, further comprising a top polymer sheet, a bottom polymer sheet, and a spacer sheet positioned between and bonded to the top and bottom polymer sheets, wherein the top polymer sheet, the bottom polymer sheet, and the spacer sheet define the first and the second chambers and the transfer channel, and wherein the spacer sheet comprises a cutout having a shape corresponding to outlines of the first chamber, the fluid channel, and the second chamber in a transverse plane.
13. The sole structure of any preceding Para, wherein the operations include (i) maintaining the voltage across the electrodes at one or more flow-inhibiting levels when an article of footwear including the sole structure is in a first location, (ii) maintaining the voltage across the electrodes at one or more flow-enabling levels in response the article of footwear traveling a first distance from the first location, (iii) after (ii), maintaining the voltage across the electrodes at one or more flow-inhibiting levels, and (iv) after (iii), maintaining the voltage across the electrodes at one or more flow-enabling levels in response to the article of footwear traveling a second distance from the first location.
14. The sole structure of any preceding Para, further comprising a gyroscope and an accelerometer, wherein the gyroscope and the accelerometer are communicatively coupled to the controller.
15. The sole structure of Para 14 when dependent on Para 13, wherein the operations include determining that the article of footwear has traveled the first and the second distances from the first location by determining numbers of steps taken by a wearer of the article of footwear.
16. The sole structure of any preceding Para, wherein the sole structure is configured to increase an angle of a part of the footbed including the first and the second portions, relative to an outsole portion positioned under the first and the second chambers, by at least 5 degrees.
17. The sole structure of any preceding Para, wherein the sole structure is configured to increase an angle of a part of the footbed including the first and the second portions, relative to an outsole portion positioned under the first and the second chambers, by at least 10 degrees.

18. An article of footwear comprising the sole structure of any preceding Para.

19. An article of footwear comprising an upper; a sole structure, the sole structure including a first chamber containing an electrorheological fluid and having a height that varies in response to transfer of the electrorheological fluid into and out of the first chamber, a second chamber containing the electrorheological fluid and having a height that varies in response to transfer of the electrorheological fluid into and out of the second chamber, a transfer channel in fluid communication with interiors of the first and second chambers and containing the electrorheological fluid, and electrodes positioned to create, in response to a voltage across the electrodes, an electrical field in at least a portion of the electrorheological fluid in the transfer channel; and a controller including a processor and memory, at least one of the processor and memory storing instructions executable by the processor to perform operations that include maintaining the voltage across the electrodes at one or more flow-inhibiting levels at which flow of the electrorheological fluid through the transfer channel is blocked, and that further include maintaining the voltage across the electrodes at one or more flow-enabling levels permitting flow of the electrorheological fluid through the transfer channel.

20. The article of footwear of Para 19, wherein the sole structure further includes a first support plate positioned under the first and the second chambers and a second support plate positioned over the first and the second chambers.

21. The article of footwear of Para 19 or 20, wherein the transfer channel has a serpentine shape.

22. The article of footwear of any of Paras 19 to 21, wherein the electrodes are located on inner walls of the transfer channel.

23. The article of footwear of any of Paras 19 to 22, further comprising a top polymer sheet, a bottom polymer sheet, and a spacer sheet positioned between and bonded to the top and bottom polymer sheets, wherein the top polymer sheet, the bottom polymer sheet, and the spacer sheet define the first and the second chambers and the transfer channel, and wherein the spacer sheet comprises a cutout having a shape corresponding to outlines of the first chamber, the fluid channel, and the second chamber in a transverse plane.

24. The article of footwear of any of Paras 19 to 23, wherein the operations include (i) maintaining the voltage across the electrodes at one or more flow-inhibiting levels when an article of footwear including the sole structure is in a first location, (ii) maintaining the voltage across the electrodes at one or more flow-enabling levels in response the article of footwear traveling a first distance from the first location, (iii) after (ii), maintaining the voltage across the electrodes at one or more flow-inhibiting levels, and (iv) after (iii), maintaining the voltage across the electrodes at one or more flow-enabling levels in in response to the article of footwear traveling a second distance from the first location.

25. The article of footwear of Paras 19 to 24, wherein the sole structure is configured to increase an angle of a part of the footbed including the first and the second portions, relative to an outsole portion positioned under the first and the second chambers, by at least 10 degrees.

26. The article of footwear of Paras 19 to 24, wherein the controller is located in the sole structure.

The invention claimed is:

1. An article of footwear comprising:

an upper; and a sole structure attached to the upper, the sole structure comprising a forefoot region, a midfoot region, a heel region, and an incline adjuster beginning and terminating in the forefoot region of the sole structure, and wherein the incline adjuster comprises a top sheet and a bottom sheet forming a medial chamber, a lateral chamber, and a central portion separating the medial chamber from the lateral chamber, a transfer channel defined within the central portion and connecting the medial chamber and the lateral chamber, a pair of electrodes positioned within the transfer channel, and an electrorheological (ER) fluid filling the medial chamber, the transfer channel, and lateral chamber, the central portion having an aperture through the top sheet and the bottom sheet, wherein the transfer channel substantially surrounds the aperture;

each of the electrodes extends throughout an electrode-containing portion of the transfer channel, the pair of electrodes comprises a first electrode positioned on a first interior wall of the transfer channel and exposed to the ER fluid and a second electrode positioned on a second interior wall of the transfer channel and exposed to the ER fluid, wherein the first electrode and second electrode each comprise a span of conductive ink; and the electrode-containing portion of the transfer channel has a serpentine shape.

2. The article of footwear of claim 1, wherein the serpentine shape of the electrode-containing portion of the transfer channel comprises multiple 180° curved sections joining other sections of the electrode-containing portion of the transfer channel.

3. The article of footwear of claim 1, wherein a top and upper sidewalls of the medial chamber are configured to collapse and reduce a height of the medial chamber when the ER fluid flows from the medial chamber and into the transfer channel, and are further configured to expand and increase the height of the medial chamber when the ER fluid flows from the transfer channel and into the medial chamber, and a top and upper sidewalls of the lateral chamber are configured to collapse and reduce a height of the lateral chamber when the ER fluid flows from the lateral chamber and into the transfer channel, and are further configured to expand and increase the height of the lateral chamber when the ER fluid flows from the transfer channel and into the lateral chamber.

4. The article of footwear of claim 1, wherein the medial chamber, the lateral chamber, and the transfer channel are absent in a heel region of the sole structure, and the ER fluid is absent in the heel region of the sole structure.

5. The article of footwear of claim 1, wherein the medial chamber is located in a medial portion of the incline adjuster, the lateral chamber is located in a lateral portion of the incline adjuster, and the incline adjuster comprises a planar bottom surface that comprises a bottom surface of a medial portion, a bottom surface of the central portion, and a bottom surface of the lateral portion.

6. The article of footwear of claim 5, wherein the serpentine shape of the electrode-containing portion of the transfer channel comprises multiple 180 curved sections joining other sections of the electrode-containing portion of the transfer channel.

7. An article of footwear comprising:

an upper; and a sole structure attached to the upper, the sole structure comprising a bottom support plate, an incline adjuster, a fulcrum element, and a top support plate, and wherein the incline adjuster comprises a top sheet and a bottom sheet forming a medial chamber, a lateral chamber, and a central portion separating the medial chamber from the lateral chamber, a transfer channel defined within the central portion and connecting the medial chamber and the lateral chamber, a pair of electrodes positioned within the transfer channel, and an electrorheological (ER) fluid filling the medial chamber, the transfer channel, and lateral chamber, the central portion having an aperture through the top sheet and the bottom sheet, wherein the transfer channel substantially surrounds the aperture;

the incline adjuster is positioned above a top surface of the bottom support plate and below a bottom surface of the top support plate, the fulcrum element extends from the top surface of the bottom support plate to the bottom surface of the top support plate, at least a portion of the fulcrum element is positioned between the medial and lateral chambers and through the aperture, a top and upper sidewalls of the medial chamber are configured to collapse and reduce a height of the medial chamber when the ER fluid flows from the medial chamber and into the transfer channel, and are further configured to expand and increase the height of the medial chamber when the ER fluid flows from the transfer channel and into the medial chamber, a top and upper sidewalls of the lateral chamber are configured to collapse and reduce a height of the lateral chamber when the ER fluid flows from the lateral chamber and into the transfer channel, and are further configured to expand and increase the height of the lateral chamber when the ER fluid flows from the transfer channel and into the lateral chamber;

each of the electrodes extends throughout an electrode-containing portion of the transfer channel, the pair of electrodes comprises a first electrode positioned on a first interior wall of the transfer channel and exposed to the ER fluid and a second electrode positioned on a second interior wall of the transfer channel and exposed to the ER fluid, wherein the first electrode and second electrode each comprise a span of conductive ink; and the electrode-containing portion of the transfer channel has a serpentine shape.

8. The article of footwear of claim 7, wherein the bottom support plate, the incline adjuster, the fulcrum element, and the top support plate are configured so that an increase in the height of the lateral chamber combined with a decrease in the height of the medial chamber pivots the top support plate about the fulcrum element in a first direction, a decrease in the height of the lateral chamber combined with an increase in the height of the medial chamber pivots the top support plate about the fulcrum element in a second direction, the second direction being different from the first direction.

9. The article of footwear of claim 7, wherein the bottom support plate, the incline adjuster, the fulcrum element, and the top support plate are configured so that inhibiting flow of the ER fluid in the transfer channel fixes an incline angle of the top support plate relative to the bottom support plate.

10. The article of footwear of claim 7, wherein the medial chamber, the lateral chamber, and the transfer channel are absent in a heel region of the sole structure, and the ER fluid is absent in a heel region of the sole structure.

11. The article of footwear of claim 7, wherein the sole structure comprises an outsole and a foam midsole, the bottom support plate is positioned above the outsole, and the top support plate is positioned below the foam midsole.

12. The article of footwear of claim 7, wherein the electrode-containing portion of the transfer channel has a length of at least 257 millimeters.

13. The article of footwear of claim 7, further comprising:

a medial force-sensing resistor (FSR) positioned between the bottom support plate and the medial chamber;

a lateral FSR positioned between the bottom support plate and the lateral chamber;

a DC-to-high-voltage-DC converter in electrical communication with the electrodes;

a processor configured to receive signals from the medial FSR and the lateral FSR and to control an output of the DC-to-high-voltage-DC converter; and a memory comprising instructions stored on said memory, wherein the stored instructions are executable by the processor to cause the processor to control the DC-to-high-voltage-DC converter to apply, to the electrodes and based on the signals from the medial FSR and the lateral FSR, a flow-inhibiting voltage at which flow of the ER fluid through the transfer channel is blocked.

14. The article of footwear of claim 7, further comprising:

a medial force-sensing resistor (FSR) positioned between the bottom support plate and the medial chamber;

a lateral FSR positioned between the bottom support plate and the lateral chamber;

a DC-to-high-voltage-DC converter in electrical communication with the electrodes;

a processor configured to receive signals from the medial FSR and the lateral FSR and to control an output of the DC-to-high-voltage-DC converter; and a memory comprising instructions stored on said memory, wherein the stored instructions are executable by the processor to cause the processor to control the DC-to-high-voltage-DC converter to apply, to the electrodes and based on the signals from the medial FSR and the lateral FSR, a flow-enabling voltage permitting flow of the ER fluid through the transfer channel.

15. The article of footwear of claim 7 wherein the fulcrum element comprises hard rubber.

16. An article of footwear comprising:

an upper; and a sole structure attached to the upper, the sole structure comprising a bottom support plate, an incline adjuster, and a top support plate, and wherein the incline adjuster comprises a medial chamber, a lateral chamber, a central portion separating the medial chamber from the lateral chamber, a transfer channel defined within the central portion and connecting the medial chamber and the lateral chamber, a pair of electrodes positioned within the transfer channel, and an electrorheological (ER) fluid filling the medial chamber, the transfer channel, and lateral chamber, and the incline adjuster is positioned above a top surface of the bottom support plate and below a bottom surface of the top support plate;

a processor; and memory comprising instructions stored on the memory, wherein the stored instructions are executable by the processor to cause the processor to perform steps that comprise determining that a change of an incline angle of the top support plate, relative to the bottom support plate, is not required, and in response to the determining that the change of the incline angle of the top support plate is not required, maintaining a voltage across the electrodes at one or more flow-inhibiting levels preventing flow of the ER fluid through the transfer channel.

17. The article of footwear of claim 16, wherein the stored instructions are executable by the processor to cause the processor to perform additional steps that comprise determining that the change of the incline angle of the top support plate, relative to the bottom support plate, to a maximum incline angle is required, determining that a pressure in one of the medial and lateral chambers is higher than a pressure in the other of the medial and lateral chambers, and based on the determining that the change of the incline angle of the top support plate to the maximum incline angle is required, and based on the determining that the pressure in the one of the medial and lateral chambers is higher than the pressure in the other of the medial and lateral chambers, maintaining the voltage across the electrodes at one or more flow-enabling levels permitting flow of the ER fluid through the transfer channel.

18. The article of footwear of claim 17, wherein the stored instructions are executable by the processor to cause the processor to perform additional steps that comprise determining, after the determining that the change of the incline angle of the top support plate to the maximum incline angle is required, but before the incline angle of the top support plate, relative to the bottom support plate, has reached the maximum incline angle, that the pressure in the one of the medial and lateral chambers is not higher than the pressure in the other of the medial and lateral chambers, and in response to determining that the pressure in the one of the medial and lateral chambers is not higher than the pressure in the other of the medial and lateral chambers, maintaining the voltage across the electrodes at one or more flow-inhibiting levels preventing flow of the ER fluid through the transfer channel.

19. The article of footwear of claim 17, wherein the stored instructions are executable by the processor to cause the processor to perform additional steps that comprise determining that a change of the incline angle of the top support plate, relative to the bottom support plate, to a minimum incline angle is required, determining that the pressure in the other of the medial and lateral chambers is higher than the pressure in the one of the medial and lateral chambers, and based on the determining that the change of the incline angle of the top support plate to the minimum incline angle is required, and based on the determining that the pressure in the other of the medial and lateral chambers is higher than the pressure in the one of the medial and lateral chambers, maintaining the voltage across the electrodes at one or more flow-enabling levels permitting flow of the ER fluid through the transfer channel.

* * * * *